United States Patent [19]

Inoue et al.

[11] Patent Number: 5,009,993

[45] Date of Patent: Apr. 23, 1991

[54] DIRECT POSITIVE PHOTOGRAPHIC MATERIAL

[75] Inventors: Noriyuki Inoue; Tatsuo Heki, both of Kanagawa, Japan

[73] Assignee: Fuji Photo Film Co., Ltd., Kanagawa, Japan

[21] Appl. No.: 422,268

[22] Filed: Oct. 16, 1989

Related U.S. Application Data

[62] Division of Ser. No. 101,693, Sep. 28, 1987, Pat. No. 4,880,727.

[30] Foreign Application Priority Data

Sep. 26, 1986 [JP] Japan ..... 61-226292
Sep. 26, 1986 [JP] Japan ..... 61-226295

[51] Int. Cl.[5] ..... G03C 1/09
[52] U.S. Cl. ..... 430/605; 430/409; 430/410; 430/510; 430/598; 430/603; 430/604
[58] Field of Search ..... 430/598, 603, 604, 605, 430/409, 410, 378, 510, 940

[56] References Cited

U.S. PATENT DOCUMENTS 2,688,601 9/1954 Herz ..... 252/313
3,392,021 7/1968 McGuckin ..... 96/84

FOREIGN PATENT DOCUMENTS 63-261360 10/1988 Japan ..... 430/378
950636 2/1964 United Kingdom ..... 430/604
2044944 10/1980 United Kingdom .

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A direct positive photographic material comprising a support having provided thereon one or more hydrophilic colloid containing layers, wherein at least one of said hydrophilic colloid containing layers is an internal latent image type silver halide emulsion which has not been previously fogged and at least one of said emulsion layer or other hydrophilic colloid containing layer contains a colloidal metal or a colloidal water-insoluble metallic sulfide, selenide or telluride, and a method for forming a direct positive from the direct positive photographic material in which a light-sensitive material contains at least two layers containing colloidal silver.

5 Claims, No Drawings

DIRECT POSITIVE PHOTOGRAPHIC MATERIAL

This is a divisional of application Ser. No. 07/101,693, filed Sept. 28, 1987 now U.S. Pat. No. 4,880,727.

FIELD OF THE INVENTION

This invention relates to a positive photographic material.

BACKGROUND OF THE INVENTION

Photography by directly obtaining a positive image (a direct positive) without requiring a reversal process and a negative film is well known in the art.

Taking practical utility into consideration, conventional techniques for obtaining a positive from a direct positive silver halide photographic material, exclusive of special materials, are divided chiefly into the following two types.

One type employs a previously fogged silver halide emulsion whose fog centers (latent image) in exposed areas are destroyed making use of the solarization or Herschell effect to obtain a direct positive.

The other type uses an internal latent image type silver halide emulsion not having been fogged, which is imagewise exposed to light and then subjected to surface development either after fogging or while fogging to obtain a direct positive. The internal latent image type silver halide emulsion used herein is such an emulsion in which silver halide grains have sensitivity specs predominantly in the inside thereof and form a latent image predominantly in the inside upon exposure to light.

The methods belonging to the latter type generally enjoy higher sensitivity and are suitable for uses requiring high sensitivity as compared with the methods of the former type. The present invention belongs to the latter type.

Various techniques of this type have been proposed, such as those disclosed in U.S. Pat. Nos. 2,592,250, 2,466,957, 2,497,875, 2,588,982, 3,317,322, 3,761,266, 2,761,276, and 3,796,577, and British Patents 1,151,363, 1,140,553, and 1,011,062. According to these conventional techniques, photographic materials providing a direct positive with relatively high sensitivity can be produced.

For the details of the direct positive formation mechanism, reference can be made to it, e.g., in T. H. James, *The Theory of the Photographic Process*, 4th Ed., Ch. 7, pp. 182–193 and U.S. Pat. No. 3,761,276.

It is believed that a direct positive is formed through the following mechanism: First, imagewise exposure results in the formation of an internal latent image (a so-called positive hole) in the inside of silver halide grains, which leads to the formation of fog centers selectively on the surface of the unexposed silver halide grains by surface desensitization ascribed to the positive hole, and subsequent surface development results in formation of a direct positive on the unexposed area.

Selective formation of fog centers can be effected by a so-called light fog method in which the entire surface of a light-sensitive layer is secondarily exposed to light as described in British Patent 1,151,363 or a chemical fog method using a nucleating agent as described in *Research Disclosure*, Vol. 151, No. 15162 (November, 1976), pp. 76–78.

In the formation of a direct positive, the internal latent image type silver halide light-sensitive material is subjected to surface color development either after or simultaneously with fogging and then subjected to bleach and fixation (or blix). After the bleach-fixation, the material is usually washed with water and/or stabilized.

The direct positive formation by the above-described chemical fog method is disadvantageous in that the resulting image is apt to have poor graininess as compared with ordinary negatively working photographic materials. In particular, this disadvantage becomes conspicuous in cases where a color developing solution is fatigued with running the development process due to oxidation of the developing agent, reduction in pH, increase of bromine ions, etc., or in cases where the light-sensitive materials are preserved under severe conditions for a long time. Moreover, deterioration of graininess is accelerated as the pH of a developing solution is decreased. From the standpoint of graininess, therefore, it has conventionally been effective to carry out development processing at a pH of 12 or higher.

On the other hand, the rate of development is less, requiring a longer development time in the formation of a direct positive as compared with the formation of general negative images. Hence, the pH of a developing solution used in the formation of a direct positive has been increased to thereby reduce development time.

However, use of a developing solution having a higher pH value generally causes an increase in the minimum image density of the resulting direct positive. Further, under a high pH, the developing agent is more susceptible to deterioration due to air oxidation, so that development activity becomes subject to great variation.

The aforesaid light fog method does not require a high pH and, therefore, enjoys a relative practical advantage. Nevertheless, this method encounters various technical problems when applied to a broad photographic field for various purposes. That is, since this method is based on the formation of fog centers by photolysis of silver halide, the optimum illumination or exposure varies depending on the kind and characteristics of the silver halide used. It is, therefore, difficult to assure predictable performance. In addition, the development apparatus required is complicated and expensive. The rate of development is also unsatisfactory.

According to the direct positive formation by the above-described light fog method or chemical fog method, the rate of development is lower, requiring a longer development time as compared with general negatively working photographic materials. Hence, the pH and/or temperature of a development solution used in these methods may be increased to thereby reduce the development time. However, the use of a developing solution having a higher pH value, as mentioned above, generally causes an increase in the minimum image density of the resulting direct positive and the developing is more susceptible to deterioration due to air oxidation under a high pH, so that development activity becomes seriously reduced.

In addition to increasing the pH value of the developing solution, other known means for increasing the rate of development in the direct positive formation system include use of hydroquinone derivatives as disclosed in U.S. Pat. No. 3,227,552 and the use of mercapto compounds having a carboxyl group or sulfo group as disclosed in Japanese Patent Application (OPI) No.

170843/85. However, these compounds produce only small effects. Therefore, there has not yet been established an effective technique for increasing the maximum density of a direct positive without increasing the minimum density. In particular, there has been a demand for a technique for obtaining a sufficient maximum image density even when a low pH developing solution is employed.

On the other hand, the known direct positive light-sensitive materials have the disadvantage, mentioned above, that the resulting image is apt to have poor graininess as compared with ordinary negatively working photographic materials. In particular, this disadvantage becomes conspicuous in cases where a developing solution is fatigued during continuous processing due to oxidation of the developing agent, reduction in pH, increase of bromine ions, etc., or in cases where the light-sensitive materials are preserved under severe conditions for a long time. Therefore, it has been especially desired to develop a technique for obtaining sufficient graininess even when processing is carried out with a low pH developing solution.

SUMMARY OF THE INVENTION

Accordingly, one object of this invention is to provide a direct positive photographic material;which can form a direct positive having a sufficiently high maximum density without an increase in minimum image density.

Another object of this invention is to provide a direct positive photographic material which can form a direct positive having satisfactory graininess.

A still other object of this invention is to provide a direct positive photographic material having satisfactory graininess and high maximum image density and freedom from formation of a re-reversal negative image even when subjected to continuous processing or preserved under severe conditions.

A further object of this invention is to provide a direct positive photographic material which can form a direct positive having a sufficiently high maximum density and satisfactory graininess even when processed with a stable developer having a low pH value.

A still further object of this invention is to provide a method for forming a direct positive using a developing solution not susceptible to deterioration due to air oxidation to thereby ensure stable performance.

Also, it has now been found that the above objects can be accomplished by a method of forming a direct positive comprising imagewise exposing to light a light-sensitive material comprising a support having provided thereon at least one photographic emulsion layer containing an internal latent image type silver halide which has not been previously fogged and subjecting the exposed material to development processing with a surface color developing solution containing an aromatic primary amine color developing agent in the presence of a nucleating agent, followed by bleaching and fixation, wherein at least two layers of said light-sensitive material contain colloidal silver and said developing solution has a pH of 11.5 or lower.

It has now been found that the above objects can be accomplished by a direct positive photographic material comprising a support having provided thereon at least one hydrophilic colloid containing layer, wherein at least one of said hydrophilic colloid containing layer is an internal latent image type silver halide emulsion which has not been previously fogged and wherein said emulsion layer or other hydrophilic colloid containing layer contains colloidal metal or a colloidal water-insoluble metallic sulfide, selenide or telluride, with the proviso that when colloidal silver is said colloidal metal, said photographic includes at least two layers with colloidal silver.

DETAILED DESCRIPTION OF THE INVENTION

It is known in the art to incorporate yellow colloidal silver into a yellow filter layer of a light-sensitive material to cut blue light. Unlike this technique, the present invention achieves improvements on maximum image density and graininess by incorporating colloidal metal exclusive of colloidal silver, which has conventionally been used as a physical developing nucleus in an image-receiving layer for diffusion transfer, but has not been used in light-sensitive materials, other than for silver salt diffusion transfer, in an arbitrary layer of a light-sensitive material. Moreover, incorporation of colloidal metal is not accompanied by an increase of fog (i.e., minimum image density) that is often noted in using colloidal silver.

In the present invention, colloidal metal is incorporated as a dispersion into at least one arbitrary layer of a light-sensitive material, such as an emulsion layer or other hydrophilic colloidal layer (e.g., an intermediate layer, a yellow filter layer, a protective layer, a subbing layer, an anti-halation layer, etc.), and preferably a layer adjacent to an emulsion layer.

The colloidal metal dispersion which can be used in the present invention includes a colloidal metal dispersion obtained by reducing a corresponding metal ion in a polymer solution.

The colloidal dispersion of a water-insoluble metallic sulfide, selenide or telluride may be prepared by mixing a metallic ion solution with a soluble sulfide, selenide or telluride.

The polymer to be used may be either water-soluble or water-insoluble, with the water-soluble polymers being preferred.

The water-soluble polymers include proteins, such as gelatin, gelatin derivatives, graft polymers of gelatin with other high polymers, albumin, casein, etc.; cellulose derivatives, such as hydroxyethyl cellulose, carboxymethyl cellulose, cellulose acetate, etc.; sugar derivatives, such as sodium alginate, starch derivatives, etc.; and a wide variety of synthetic hydrophilic high polymers, such as polyvinyl alcohol, polyvinyl alcohol partial acetal, poly-N-vinylpyrrolidone, polyacrylic acid, polyme.thacrylic acid, polyacrylamide, polyvinyl pyrrolidone, polyvinyl imidazole, polyvinylpyrazole, etc. and copolymers comprising monomers constituting these homopolymers.

Metals and metallic sulfides, selenides and tellurides which can be used in the direct positive photographic material of the present invention include heavy metals, e.g., mercury, iron, lead, zinc, nickel, cadmium, tin, chromium, copper, cobalt, silver, gold, platinum, palladium, etc., and sulfides, selenides or tellurides of these metals, and sulfides, selenides or tellurides of aluminum, silver, antimony, bismuth, cerium or magnesium. Preferred among these metals or metal compounds are nickel, iron, cobalt, copper, palladium, gold, platinum, sulfides of these metals, and silver sulfide. More preferred are nickel, palladium, gold, platinum, and sulfides of nickel, palladium, gold or silver and these may be used either alone or in combination.

The amount of the colloidal metal to be added ranges from to $10^{-3}$ mol, preferably from $10^{-9}$ to $10^{-4}$ mol, and more preferably from $10^{-8}$ to $10^{-4}$ mol, per $m^2$.

The metals are used in the form of a nitrate, carbonate, silicate, borate, acetate, phosphate, halide, cyanide, thiocyanide, etc.

Reducing agents to be used for the preparation of colloidal metal include phenols, e.g., hylroquinone, methylhydroquinone, t-butylhydroquinone, chlorohydroquinone, pyrogallol, pyrocatechin, paraphenylenediamine, 1,4-dihydronaphthalene, etc., and 5-membered compounds, e.g., 1-phenyl3-pyrazolidone, 1-(p-aminophenol)-3-amino-2-pyrazolidone, etc. Specific examples of these reducing agents are described in C. E. K. Meas and T. H. James, *The Theory of the Photographic Process,* 3rd Ed., pp. 278–306. Reducing sugars, e.g., dextrin, glucose, etc. can also be used. In addition, sodium boron hydride, potassium boron, hydride, t-butylamine borane, dithionites, and hydrazine compounds are preferably used. Reduction may also be effected with hydrogen gas.

Sulfiding agents to be used preferably include sodium sulfide and potassium sulfide.

These reducing agents or sulfiding agents are usually used in an amount of from about 0.5 mol to about 10 mols, and preferably from 0.8 to 5 mols, per mol of metal.

It is widely known in the art that yellow colloidal silver, for the purpose of absorbing blue light, is incorporated in a yellow filter layer provided between a blue-sensitive emulsion layer and a green-sensitive emulsion layer. According to the method of forming a direct positive of the present invention, satisfactory graininess that would normally be susceptible to deterioration at a low pH can be assured and also a high color-image density can be attained for the first time by a combination of (1) a light-sensitive material having at least two layers containing colloidal silver and (2) development processing at a low pH of 11.5 or lower which is unusual in processing in the presence of a nucleating agent. In other words, the present invention is based on a new unexpected finding that colloidal silver improves not only image graininess but image density in the presence of a nucleating agent and under a low pH condition.

Japanese Patent Application (OPI) No. 127549/80, pp. 10–11 (the term "OPI" as used herein means "unexamined published application") discloses a light fog method in which a direct positive light-sensitive material contains yellow colloidal silver in a yellow filter layer and gray colloidal silver in an intermediate layer. However, the direct positive light-sensitive material containing colloidal silver in at least two layers thereof as proposed failed to produce the above-described effects as attained by the present invention even when combined with a light fog method. Also, it has now been found that the above objects can be accomplished by a method of forming a direct positive comprising imagewise exposing to light a light-sensitive material comprising a support having provided thereon at least one photographic emulsion layer containing an internal latent image type silver halide which has not been previously fogged and subjecting the exposed material to development processing with a surface color developing solution containing an aromatic primary amine color developing agent in the presence of a nucleating agent, followed by bleaching and fixation, wherein at least two layers of said light-sensitive material contain colloidal silver and said developing solution has a pH of 11.5 or lower.

Colloidal silver which can be used in the method of forming a direct positive of the present invention may have any color, e.g., yellow, brown, blue, black, etc. The colloidal silver in the individual layers may be different in color from each other. The two or more layers in which colloidal silver is incorporated are not particularly limited and can be selected appropriately and arbitrarily from emulsion layers and non-emulsion layers, and preferably from layers adjacent to emulsion layers. From a consideration of its function as a filter layer, it is preferable to add yellow colloidal silver in a layer beneath a blue-sensitive layer. Colloidal silver may be used with other colloidal metal.

The amount of the colloidal silver to be added preferably ranges from 0.0001 to 0.4 $g/m^2$, and more preferably from 0.0003 to 0.3 $g/m^2$.

Preparation of various types of colloidal silver is described in the literature, e.g., Weiser, *Colloidal Elements,* Wiley & Sons, New York (1933) concerning yellow colloidal silver prepared by a Carey Lea's dextrin reduction method; German Patent 1,096,193 concerning brown or black colloidal silver; and U.S. Patent 2,688,601 concerning blue colloidal silver.

Reducing agents which can be used in the preparation of colloidal silver are known and conventional and include, for example, phenols, e.g., hydroquinone, methylhydroquinone, t-butylhydroquinone, pyrogallol, pyrocatechin, p-phenylenediamine, 1,4-di-hydronaphthalene, etc.; and 5-membered ring compounds, e.g., 1-phenyl-3-pyrazolidone, 1-(p-aminophenol)-3-amino-2-pyrazolidone, etc. These and many other specific examples of usable reducing agents are described in C. E. Meas and T. H. James, *The Theory of the Photographic Process,* 3rd Ed., pp. 278–306. Reducing sugars, such as dextrin, glucose, etc., may also be employed. In addition to the above-described organic compounds, inorganic compounds, such as sodium boron hydride, potassium oron hydride, t-butylamine borane, dithionites, ferrous oxalate, sodium hydrosulfite, hydroxylamine, hydrazine, and salts of a polyvalent metal (e.g., titanium, vanadium, tin, etc.), may also be used in the present invention.

The preparation of colloidal silver may also be carried out according to the methods disclosed in German Patent Publication (OLS) No. 1917745, Japanese Patent Publication No. 6636/78, Japanese Patent Application (OPI) No. 89722/76, and U.S. Pat. No. 4,094,811.

These reducing agents are used in an amount of from about 0.5 to 10 mols, and preferably from 0.8 to 5 mols, per mol of silver.

Silver salts to be used for the preparation of colloidal silver include water-soluble silver salts, such as silver nitrate, ammonium silver complex salts, etc.; and fine dispersions of silver salts, such as silver halides (e.g., silver chloride, silver bromide, silver iodide, silver chlorobromide, etc.).

In the preparation of a coating composition for the colloidal silver-containing layer, a protective colloid may or may not be present at the time of mixing but should be present at least before washing of a dispersion.

Protective colloids that may be used include starch, dextran, amylolysis products of starch (e.g., dextrin, etc.); proteins, such as gelatin, gelatin derivatives, graft polymers of gelatin and other high polymers, albumin, casein, etc.; cellulose derivatives, such as hydroxyethyl cellulose, carboxymethyl cellulose, cellulose sulfate, etc.; sugar derivatives, such as sodium alginate, starch derivatives, etc.; and synthetic hydrophilic polymers, such as polyvinyl alcohol, polyvinyl alcohol partial acetal, poly-N-vinylpyrrolidone, polyacrylic acid, polymethacrylic acid, polyacrylamide, polyvinyl pyrrolidone, polyvinylimidazole, polyvinylpyrazole, etc., and copolymers comprising monomers constituting these homopolymers.

Gelatins that may be used as a protective colloid may be any of lime-processed gelatin, acid-processed gelatin, enzyme-processed gelatin as described in *Bull. Soc. Sci. Phot. Japan*, No. 16, 30 (1966), and hydrolysates or enzymatic decomposition products of gelatin.

Gelatin derivatives that may be used as a protective colloid can be obtained by reacting gelatin with various compounds, such as acid halides, acid anhydrides, isocyanates, bromoacetic acid, alkanesulfones, vinylsulfonamides, maleimide compounds, polyalkylene oxides, epoxy compounds, and so on.

Stirring, concentration, and the like in the preparation of colloidal silver are carried out in an usual manner. The manner described in Japanese Patent Application (OPI) No. 91103/83 and U.S. Pat. No. 4,429,038 may also be adopted.

The internal latent image type silver halide emulsion that is not previously fogged which can be used in the present invention is an emulsion containing silver halide grains which form a latent image chiefly in the inside thereof, the surface of which has not been fogged previously.

More specifically, when such a silver halide emulsion coated on a transparent support to obtain a silver coverage of from 0.5 to 3 g/m$^2$ is exposed to light for a fixed exposure time o from 0.01 to 10 seconds and developed in a developer having Formulation A shown below (internal developer) at 18° C. for 5 minutes, it is desirable that the maximum density of the resulting image as measured in an usual manner be at least 5 times greater, and more preferably at least 10 times greater, than that of an image obtained by developing the same exposed sample in a developer having Formulation B shown below (surface developer) at 20° C. for 6 minutes.

| | |
|---|---|
| Formulation A: | |
| Metol (p-methylaminophenol) | 2 g |
| Anhydrous sodium sulfite | 90 g |
| Hydroquinone | 8 g |
| Sodium carbonate monohydrate | 52.5 g |
| Potassium bromide | 5 g |
| Potassium iodide | 0.5 g |
| Water to make | 1 l |
| Formulation B: | |
| Metol (p-methylaminophenol) | 2.5 g |
| l-Ascorbic acid | 10 g |
| $NaBO_2.4H_2O$ | 35 g |
| Potassium bromide | 1 g |
| Water to make | 1 l |

Specific examples of the internal latent image type emulsions are conversion type silver halide emulsions as described in U.S. Pat. No. 2,592,250, Japanese Patent Publication Nos. 54379/83, 3536/83, and 5582/85, and Japanese Patent Application (OPI) Nos. 156614/77, 79940/82, and 70221/83; those conversion type emulsions having a shell; and core-shell type silver halide emulsions having its inside doped with a metal as described in U.S. Pat. Nos. 3,761,276, 3,850,637, 3,923,513, 4,035,185, 4,395,478, 4,431,730, and 4,504,570, Japanese Patent Application (OPI) Nos. 60222/78, 22681/81, 208540/84, 107641/85, and 3137/86, Japanese Patent Application No. 3642/86, and patents cited in *Research Disclosure*, No. 23510, p. 236 (November, 1983) and ibid, No. 18155, pp. 265–268 (May, 1979).

The silver halide grains to be used in the present invention may have a regular crystal form, such as a cubic, octahedral, dodecahedral or tetradecahedral form, an irregular crystal form, such as a spherical form, a plate-like (tabular) form having an aspect ratio of 5 or more, or a composite crystal form thereof.

The halogen composition of the silver halide grains includes silver chloride, silver bromide, and a mixed silver halide. The silver halide which can be preferably used in the present invention is selected from those containing no silver iodide or containing up to 3 mol% of silver iodide, i.e., silver (iodo)bromide, silver (iodo)chloride and silver (iodo)bromide.

The silver halide grains preferably have a mean grain size of from 0.1 to 2 μm, and more preferably from 0.15 to 1 μm.

Grain size distribution may be either narrow or broad, but it is preferable from the standpoint of improvement of graininess, sharpness, and the like to use a monodispersed silver halide emulsion having a narrow size distribution in which at least 90% of the weight or number of the total grains may fall within a size range of 40% of the mean grain size.

In order that the light-sensitive material should satisfy a desired gradation, two or more kinds of mono-dispersed silver halide emulsions being different in grain size or two or more kinds of silver halide emulsions being different in sensitivity may be mixed and coated in a single layer or separately coated to provide plural emulsion layers having substantially the same color sensitivity.

Further, a combination of two or more kinds of poly-dispersed silver halide emulsions or a combination of a mono-dispersed emulsion and a poly-dispersed emulsion may be coated in a single layer or coated in separate layers.

The silver halide emulsions to be used in the present invention can be subjected to chemical sensitization of the surface or inside of the individual grains by selenium sensitization, reduction sensitization,.noble metal sensitization, etc., either individually or with a combination of these sensitization techniques. The details concerning chemical sensitization are described in patents cited in *Research Disclosure*, No. 17643-III, p. 23 (December, 1978).

The photographic emulsions are spectrally sensitized in the usual manner. Particularly useful dyes for spectral sensitization include cyanine dyes, merocyanine dyes, and complex merocyanine dyes. These sensitizing dyes may be used either individually or in combinations thereof. The sensitizing dyes may be used in combination with supersensitizers. Specific examples of the sensitizing dyes and supersensitizers are described in patents cited in *Research Disclosure*, No. 17643-IV, pp. 23–24 (December, 1978).

For prevention of fog during the preparation, preservation or photographic processing of the light-sensitive material or for stabilization of .ohotographic performances, the photographic emulsions can contain antifoggants or stabilizers. Specific examples of these additives are described, e.g., in *Research Disclosure*, No. 17643-VI, pp. 24–25 (December, 1978) and E. J. Birr,

*Stabilization of Photographic Silver Halide Emulsions*, Focal Press (1974).

In the formation of a direct positive, various color couplers can be employed. Useful color couplers are compounds that are per se non-diffusible and capable of forming or releasing a dye, preferably a substan.tially nondiffusible dye, upon coupling with an oxidation product of an aromatic primary amine color developing agent. Such color couplers typically include cyan-forming couplers, such as naphthol or phenol compounds, magenta-forming couplers, such as pyrazolone or pyrazolone-azole compounds, and yellow couplers, such as open-chain or heterocyclic ketomethylene compounds. Specific examples of these cyan, magenta, and yellow couplers are described in *Research Disclosure*, No. 17643, p..25, CII-D (December, 1978), ibid, No. 18717 (November, 1979), and Japanese Patent Application No. 32462/76, pp. 298–373, and patents cited in these references.

In particular, the yellow couplers to be used typically include 2-equivalent couplers of the oxygen-release type or nitrogen-release type. Among them, α-pivaloylacetanilide couplers are preferred because of fastness, particularly to light, of a developed color; and α-benzoylacetanilide couplers are preferred because of the high color density obtained.

The 5-pyrazolone magenta couplers that are preferred in the present invention include those having an arylamino group or acylamino group at the 3-position, and particularly 2-equivalent couplers of the sulfur-release type. More preferred are pyrazoloazole couplers. Of the pyrazoloazole couplers, pyrazolo[5,1-c][1,2,4]triazoles disclosed in U.S. Pat. No. 3,725,067 are preferred. More preferred are imidazol[1,2-b]pyrazoles disclosed in U.S. Pat. No. 4,500,630 in view of the small amount of yellow side absorption and the light-fastness of the developed color. The most preferred is pyrazolo[1,5-b][1,2,4]triazole disclosed in U.S. Pat. No. 4,540,654.

Cyan couplers which can be preferably used in the present invention include naphthol and phenol couplers described in U.S. Pat. Nos. 2,474,293 and 4,052,2112, etc., phenol couplers having an alkyl group having 2 or moe carbon atoms at the m-position of the phenol nucleus as described in U.S. Pat. No. 3,772,002 and, in addition, 2,5-diacylamino-substituted phenol couplers in view of dye image fastness.

Specific examples of particularly preferred yellow, magenta, and cyan couplers are those recited in Japanese Patent Application No. 169523/86, pp. 35–51. Additional examples of preferred magenta, yellow, and cyan couplers are shown below along with compound numbers headed by initials M, Y, and C, respectively.

(M-12)

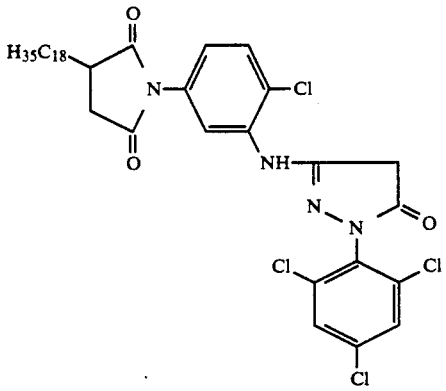

(M-13)

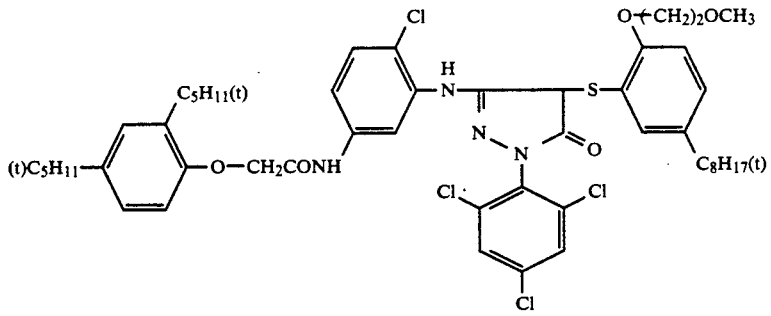

(M-14)

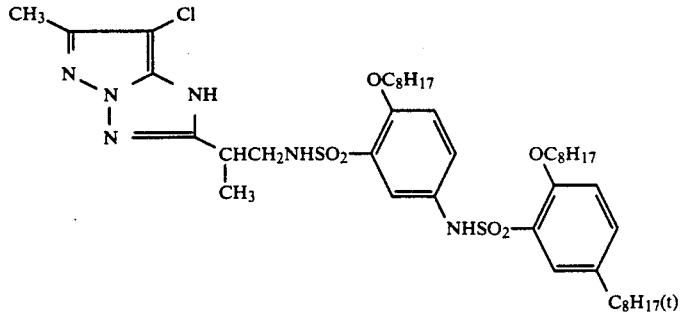

-continued
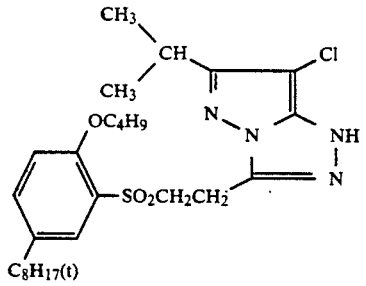
(M-15)
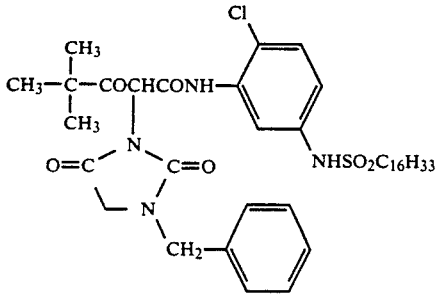
(Y-9)
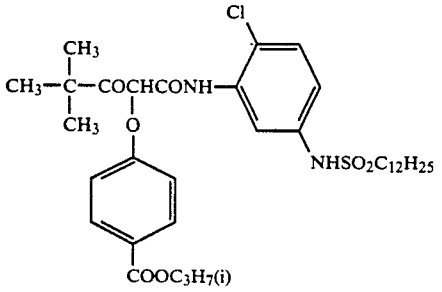
(Y-10)
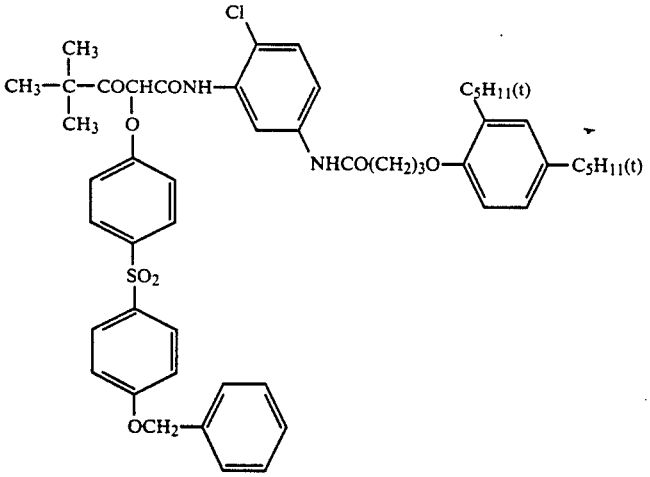
(Y-11)
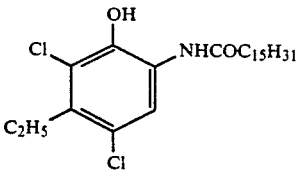
(C-10)

-continued (C-11)

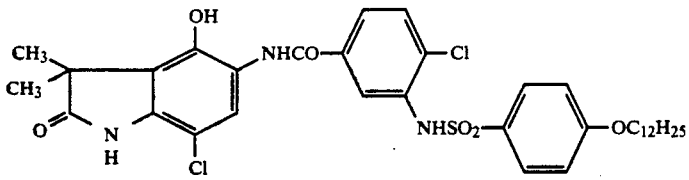

In addition to the above-described color couplers, colored couplers for correcting unwanted absorption in a short wavelength region possessed by the dyes produced, couplers that produce dyes having moderate diffusibility, colorless couplers, DIR couplers capable of releasing a development inhibitor upon the coupling reaction, couplers capable of releasing a development accelerator upon coupling, or polymerized couplers may also be used in the present invention.

Standard amounts of the color couplers to be used ranges from 0.001 to 1 mol per mol of light-sensitive silver halide and preferably from 0.01 to 0.5 mol for yellow couplers; from 0.003 to 0.5 mol for magenta couplers; and from 0.002 to 0.5 mol for cyan couplers.

The light-sensitive materials according to the present invention may contain color fog preventing agents or color mixing preventing agents, such as hydroquinone derivatives, aminophenol derivatives, amines, gallic acid derivatives, catechol derivatives, ascorbic acid derivatives, colorless couplers, sulfonamidophenol derivatives, and the like. Typical examples of these additives are described in Japanese Patent Application No. 32462/86, pp. 600–630.

The light-sensitive materials of the present invention can further contain various discoloration inhibitors, including organic compounds, such as hydroquinones, 6-hydroxychromans, 5-hydroxycoumarans, spirochromans, p-alkoxyphenols, hindered phenols chiefly derived from bisphenols, gallic acid derivatives, methylenedioxybenzenes, aminophenols, hindered amines, and derivatives derived from these compounds by esterification or etherification of the phenolic hydroxyl group with a silyl group or an alkyl group. Further, metal complexes, such as a (bissalicylaldoximato)nickel complex and a (bis-N,N-dialkyldithiocarbamato)nickel complex, can also be used.

Compounds having both of a partial structure of hindered amines and a partial structure of hindered phenols in a molecule thereof, such as those disclosed in U.S. Pat. No. 4,268,593 produce good results for preventing yellow dye image deterioration due to heat, humidity and light. For preventing magenta dye image deterioration, particularly due to light, spiroindanes described in Japanese Patent Application (OPI) No. 259644/81 and hydroquinone diether or monoether-substituted chromans described in Japanese Patent Application (OPI) No. 89835/80 are effective.

Typical examples of these discoloration inhibitors are described in Japanese Patent Application No. 32462/86, pp. 401–440. Incorporation of these compounds into lightsensitive layers can be carried out by co-emulsifying the corresponding color coupler together with the compound usually in an amount of from 5 to 100% by weight based on the coupler.

For the purpose of preventing cyan dye image deterioration due to heat and, in particular, light, it is effective to introduce ultraviolet absorbents in both layers adjacent to the cyan forming layer. The ultraviolet absorbents may also be added to hydrophilic colloidal layers, such as a protective layer. Typical examples of usable ultraviolet absorbents are described in Japanese Patent Application No. 32462/86, pp. 391–400.

Binders or protective colloids which can be used in the emulsion layers or intermediate layers of the light-sensitive materials include hydrophilic colloids. Gelatin is a particularly useful hydrophilic colloid.

The light-sensitive materials of the present invention can further contain dyes for preventing irradiation or halation, ultraviolet absorbents, plasticizers, fluorescent brightening agents, matting agents, aerial fog inhibitors, coating aids, hardening agents, antistatic agents, agents for improvihg slipperiness, and the like. Typical examples of these additives are described in *Research Disclosure*, No. 17643, VIII-XIII, pp. 25–27 (December, 1978) and ibid, No. 18716, pp. 647–651 (November, 1979).

The present invention is applicable to multilayer multi-color .photographic materials comprising at least two layers different in spectral sensitivity. Multilayer natural color -ohotographic materials generally comprise a support having provided thereon at least one red-sensitive emulsion layer, at least one green-sensitive emulsion layer, and at least one blue-sensitive emulsion layer in an arbitrary order, and preferably in the order of support/red-sensitive layer/green-sensitive layer/blue-sensitive layer or in the order of support/green-sensitive layer/red-sensitive layer/blue-sensitive layer. Each of the red-, greenand blue-sensitive emulsion layers may be composed of two or more independent layers having the same color sensitivity. A light-insensitive layer may be present between the two or more emulsion layers of the same sensitivity. The red-sensitive emulsion layer, the green-sensitive emulsion layer, and the blue-sensitive emulsion layer are usually combined with cyan-forming couplers, magenta-forming couplers, and yellow-forming couplers, respectively, but other combinations may also be employed in some cases.

In addition to the above-described silver halide emulsion layers, the light-sensitive materials preferably comprise.auxiliary layers, such as a protective layer, an intermediate layer, a filter layer, an antihalation layer, a backing layer, a white reflecting layer., and the like.

The support on which the photographic emulsion layers and other layers are coated includes those described in *Research Disclosure*, No. 17643, XVII, p. 28 (December, 1978), European Patent 182,253 and Japanese Patent Application (OPI) No. 97655/86. The coating method described in *Research Disclosure*, No. 17643, XV, pp. 28–29 can be utilized.

In cases where the present invention is applied to a color diffusion transfer process, dye developers can be employed as color formers. It is advantageous to use a color former which is per se alkaline (in a developing solution) and non-diffusible (immobile), but releases a diffusible dye or a precursor thereof upon development. Such a color former capable of releasing a diffusible dye, i.e., DRR compound, include s a coupler releasing a diffusible dye and a redox compound. These compounds are useful for not only a color diffusion transfer process (wet process) but also a heat development process (dry process) as disclosed in Japanese Patent Application (OPI) No. 58543/83.

The aforesaid diffusible dye-releasing redox compound may, for example, be represented by the following formula:

(Ballast)(Redox Cleavable Atomic Group)D wherein (Ballast) and (Redox Cleavable Atomic Group) each includes those described in Japanese Patent Application (OPI) No. 163938/83, pp. 12–22; and D represents a dye moiety or a precursor of a dye moiety, which may be bonded to the redox cleavable atomic group via a linking group.

Effective examples of the dye moiety as represented by D in the above formula are described in the following references:

Examples of Yellow Dyes

U.S. Pat. Nos. 3,597,200, 3,309,199, 4,013,633, 4,245,028, 4,156,609, 4,139,383, 4,195,992, 4,148,641, 4,148,643, and 4,336,322; Japanese Patent Application (OPI) Nos. 114930/76 and 71072/81; *Research Disclosure*, No. 17630 (1978), and ibid. No. 16475 (1977).

Examples of Magenta Dye

U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,282; and Japanese Patent Application (OPI) Nos. 106727/77, 106727/77, 23628/78, 36804/80, 73057/81, 71060/81, and 134/80.

Examples of Cyan Dyes

U.S. Pat. Nos. 3,482,972, 3,939,760, 4,013,635, 4,268,625, 4,171,220, 4,242,435, 4,142,891, 4,195,994, 4,147,544, and 4,148,642; British Patent 1,551,138; Japanese Patent Application (OPI) Nos. 99431/79, 8827/77, 47823/78, 143323/78, 99431/79, and 71061/81; European Patents (EPC) 53,037 and 53,040; and *Research Disclosure*, Nos. 17630 (1978) and 16475 (1977).

These compounds are usually coated in an amount of from about $1\times10^{-4}$ to $1\times10^{-2}$ mol/m$^2$, and preferably from $2\times10^{-4}$ to $2\times10^{-2}$ mol/m$^2$.

The color former may be added to a silver halide emulsion layer with which it is combined or may be added to a neighboring layer on either side of the emulsion layer.

When the present invention is applied to a color diffusion transfer process, the photographic emulsion layers may be coated on the support on which an image-receiving layer is coated or a separate suppot. The silver halide emulsion layer (light-sensitive element) and an image-receiving layer (image-receiving element) may be combined in the form of a film unit or may be provided as an independent photographic element. The film unit includes an integral type in which he light-sensitive element and the image-receiving element are united in a body from exposure and development through preservation of a transferred image and a peel-off type in which these elements are separated (peeled apart) after development. The present invention is more effectively applied to the latter type.

The present invention can also be applied to a wide variety of color light-sensitive materials, for example, color reversal films for slides or TV, color reversal papers, instant color films and, in addition, color hard copies of full color copying machines or hard copies for the preservation of a CRT image. The present invention is further applicable to black-and-white light-sensitive materials utilizing three color coupler mixing as described in *Research Disclosure*, No. 17123 (July, 1978).

According to the method of the present invention, a direct color positive can be formed by imagewise exposing the above-described light-sensitive material to light, developing the exposed material with a surface developer containing an aromatic primary amine color developing agent in the presence of a nucleating agent, and subjecting the developed material to bleaching and fixation.

The present invention is also applicable to ordinary black-and-white photographic materials. The black-and-white (hereinafter abbreviated as B/W) photographic materials to which the present invention can be applied include direct positive B/W photographic materials as described in Japanese Patent Application (OPI) Nos. 208540/84 and 260039/85, such as X-ray films, dupe films, microfilms, light-sensitive materials for photocomposing or printing, and the like.

The light-sensitive materials according to the present invention are imagewise exposed to light and then subjected to development with a surface developer containing an aromatic primary amine color developing agent while or after being fogged by light or a nucleating agent, followed by bleach-fixation to thereby form a direct color positive.

The fog processing in the present invention may be effected either by the above-described light fog method in which the entire surface of a light-sensitive layer is secondarily exposed to light or by the chemical fog method in which development processing is carried out in the presence of a nucleating agent. Development processing may also be carried out in the presence of both a nucleating agent and fogging light. It is also possible to expose a light-sensitive material containing a nucleating agent to fogging light.

The entire surface exposure according to the light fog method, i.e., fogging exposure, can be conducted after imagewise exposure and before and/or during development processing. That is, an imagewise exposed light-sensitive material is exposed to fogging light while being dipped in a developing bath or a prebath thereof or after being taken out from the bath but while wet. Exposure in the developing bath is most preferred.

Fogging exposure can be performed by means of any light sources having a sensitive wavelength of the light-sensitive material, such as a fluorescent lamp, a tungsten lamp, a xenon lamp, sunlight, etc. The details for the fogging exposure are described, e.g., in British Patent 1,151,363, Japanese Patent Publication Nos. 12710/70, 12709/70, and 6936/83, and Japanese Patent Application (OPI) Nos. 9727/73, 137350/81, 129438/82, 62652/83, 60739/83, 70223/83 (corresponding to U.S. Pat. No. 4,440,851), and 120248/83 (corresponding to European Patent 89101A2). In the case of light-sensitive materials having sensitivity over the total wavelength region, for example, panchromatic light-sensitive materials, it is desirable to use a light source exhibiting high color rendering (i.e., emitting light as close to white light as possible) as described in Japanese Patent Application (OPI) Nos. 137350/81 and 70223/83. The illumination suitably ranges from 0.01 to 2000 lux, preferably from 0.05 to 30 lux, and more preferably from 0.05 to 5 lux. It is preferable to lower the illumination as the sensitivity of emulsions used in the light-sensitive material becomes higher. The illumination can be controlled by varying luminous intensity of a light source, extinction by various filters, or varying the distance or angle between the light-sensitive material and the light source. It is possible to reduce the exposure time by using a weak light in the initial stage of exposure and then using stronger light.

In carrying out exposure, the light-sensitive material is dipped in a developing solution or a prebath thereof and exposed to light after the processing solution sufficiently penetrates into the emulsion layers. The time needed from dipping to the exposure for light fog is generally from 2 seconds to 2 minutes, preferably from 5 seconds to 1 minute, and more preferably from 10 to 30 seconds.

The time required for exposure for fogging usually ranges from 0.01 second to 2 minutes, preferably from 0.1 second to 1 minute, and more preferably from 1 to 40 seconds.

The nucleating agent which can be used in the present invention may be any of those which have been so far developed for nucleation of an internal latent image type silver halide. Two or more kinds of nucleating agents may be used. More specifically., the nucleating agents to be used in the present invention include those described in *Research Disclosure*, No. 22534, pp. 50–54 (January, 1983), ibid, No. 15162, pp. 76–77 (November, 1976), and ibid, No. 23510, pp. 364–352 (November, 1983). These compounds are divided into three large groups of (1) quaternary heterocyclic compounds represented by formula (N-I) shown below, (2) hydrazine compounds represented by formula (N-II) shown below, and (3) others.

Formula (N-I) is represented by formula

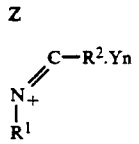

(N-I)

wherein Z represents a substituted or unsubstituted non-metal atomic group forming a 5- or 6-membered heterocyclic ring; $R^1$ represents a substituted or unsubstituted aliphatic group; $R^2$ represents a hydrogen atom, a substituted or unsubstituted aliphatic group or a substituted or unsubstituted aromatic group with the proviso that at least one of Z, $R^1$, and $R^2$ contains an alkynyl group, an acyl group, a hydrazine group or a hydrazone group, or $R^1$ and $R^2$ jointly form a 6-membered ring to form a dihydropyridinium skeleton; and at least one of Z, $R^1$, and $R^2$ may contain $X^1(L^1)_m$, wherein $X^1$ represents a group accelerating adsorption onto silver halide (hereinafter referred to as an adsorptive group); $L^1$ represents a divalent linking group; and m represents 0 or 1; Y represents a counter ion for a charge balance; and n represents 0 or 1.

In formula (N-I), the heterocyclic group formed by Z includes quinolinium, benzothiazolium, benzimidazolium, pyridinium,, thiazolinium, thiazolium, naphthothiazolium, selenazolium, benzoselenazolium, imidazolium, tetrazolium, indolenium, pyrrolinium, acridinium, phenanthridinium, isoquinolinium, oxazolium, naphthoxazolium, and benzoxazolium nuclei.

Substituents for Z are selected from an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic ester group, a hydrazine group, a hydrazone group, an imino group, etc. Two or more substituents for Z may be the same or different. The substituents for Z may further be substituted with these substituents.

Further, Z may be substituted with the aboveenumerated heterocyclic quaternary ammonium group completed by Z via an appropriate linking group to form a dimeric structure.

Preferred heterocyclic rings formed by Z are quinolinium, benzothiazolium, benzimidazolium, pyridinium, acridinium, phenanthridinium, and isoquinolinium nuclei, with quinolinium and benzothiazolium nuclei being more preferred. Of these, a quinolinium nucleus is the most preferred.

The aliphatic group represented by $R^1$ and $R^2$ includes an alkyl group having from 1 to 18 carbon atoms and a substituted alkyl group having from 1 to 18 carbon atoms in the alkyl moiety thereof. The substituents set forth above as substituents for Z can serve as substituents for the substituted alkyl group.

The aromatic group represented by $R^2$ contains from 6 to 20 carbon atoms and includes, for example, a phenyl group and a naphthyl group. The substituents set forth above as substituents for Z can serve as substituents for these aromatic groups.

$R^2$ preferably represents an aliphatic group, with a methyl group and a substituted methyl group being more preferred.

At least one of $R^1$, $R^2$, and Z contains an alkynyl group, an acyl group, a hydrazine group or a hydrazone group, or $R^1$ and $R^2$ jointly form a 6-membered ring to form a dihydropyridinium skeleton, which may be substituted with the substituents recited above for Z.

It is preferable that at least one of the groups or rings represented by $R^1$, $R^2$, and Z has an alkynyl group or an acyl group as a substituent or $R^1$ and $R^2$ jointly form a dihydropyridinium skeleton. It is more preferable that at least one of $R^1$, $R^2$, and Z contains at least one alkynyl group.

The adsorptive group represented by $X^1$ preferably includes a substituted or unsubstituted thioamido group, a substituted or unsubstituted mercapto group, and a substituted or unsubstituted 5- or 6-membered nitrogen-containing heterocyclic ring. The substituents for $X^1$ include the same groups as recited above for Z. Preferred examples for the thioamido group are acyclic thioamido group, e.g., a thiourethane group and a thioureido group. Preferred examples of the mercapto group are heterocyclic mercapto groups, e.g., 5-mercaptotetrazole, 3-mercapto-1,2,4-triazole, and 2-mercapto-1,3,4-thiadiazole. Examples of the 5- or 6-membered nitrogen-containing heterocyclic group include combinations of nitrogen, oxygen, sulfur, and carbon atoms, and preferably those forming imino-silver, such as benzotriazole.

The divalent linking group represented by $L^1$ includes atoms or atomic groups containing at least one of carbon, nitrogen, sulfur, and oxygen atoms. Specific examples of such a linking group include an alkylene group, an alkenylene group, an arylene group, —O—, —S—, —NH—, —N=, —CO—, —$SO_2$—, etc. and combinations thereof (each of these groups may have a substituent).

.The counter ion Y for charge balancing may include a bromine ion, a chlorine ion, an iodine ion, a p-toluenesulfonate ion, an ethylsulfonate ion, a perchlorate ion, a trifluoromethanesulfonate ion, a thiocyanate ion, etc.

Specific examples of the compounds reresented by formula (N-I) and processes for synthesizing these compounds are described, e.g., in patents cited in *Research Disclosure*, No. 22534, pp. 50–54 (January, 1983) and ibid, No. 23213, pp. 267–270 (August, 1983), Japanese Patent Publication Nos. 38164/74, 19452/77, and 47326/77, Japanese Patent Application (OPI) Nos. 69613/77, 3426/77, 138742/80, and 11837/85, and U.S. Pat. Nos. 4,306,016 and 4,471,044.

Specific but non-limiting examples of the compounds represented by formula (N-I) are shown below.

(N-I-1) 6-Ethoxy-2-methyl-1-propargylquinolinium bromide (N-I-2) 2,4-Dimethyl-1-propargylquinolinium bromide (N-I-3) 2-Methyl-1-{3-[2-(4-methylphenyl)hydrazono]-butyl}quinolinium iodide (N-I-4) 3,4-Dimethyl-dihydroxpyrido[2,1-b]benzothiazolium bromide (N-I-5) 6-Ethoxythiocarbonylamino-2-methyl-1-propargylquinolinium trifluoromethanesulfonate (N-I-6) 2-Methyl-6-(3-phenylthioureido)-1-propargylquinolinium bromide (N-I-7) 6-(5-Benzotriazolocarboxamido)-2-methyl-1-propargylquinolinium trifluoromethanesulfonate (N-I-8) 6-[3-(2-Mercaptoethyl)ureido]-1-methyl-1-propargylquinolinium trifuloromethanesulfonate (N-I-9) 6-{3-[3-(5-mercapto-thiadiazol-2-ylthio)propyl]-ureido-2-methyl-1-propargylquinolinium trifluoromethanesulfonate (N-I-10) 6-(5-Mercaptotetrazol-1-yl)-2-methyl-1-propargylquinolinium iodide Formula (N-II) is represented by the formula

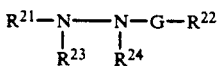

(N-II)

wherein $R^{21}$ represents a substituted or unsubstituted aliphatic group, a substituted or unsubstituted aromatic group or a substituted or unsubstituted heterocyclic group; $R^{22}$ represents a hydrogen atom, a substituted or unsubstituted alkyl group, a substituted or unsubstituted aralkyl group, a substituted or unsubstituted aryl group, a substituted or unsubstituted alkoxy group, a substituted or unsubstituted aryloxy group or a substituted or unsubstituted amino group; G represents a substituted or unsubstituted carbonyl group, a substituted or unsubstituted sulfonyl group, a substituted or unsubstituted sulfoxy group, a substituted or unsubstituted phosphoryl group or a substituted or unsubstituted iminomethylene group

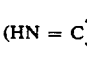

and $R^{23}$ and $R^{24}$ each represents a hydrogen atom, substituted or unsubstituted alkylsulfonyl group, a substituted or unsubstituted arylsulfonyl group or an acyl group, with at least one of them being a hydrogen atom; or G, $R^{23}$, and $R^{24}$ may combine with the hydrazine nitrogen atoms to form a hydrazone structure

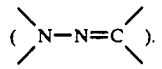

In formula (N-II), substituents for $R^{21}$ include a substituted or unsubstituted alkyl group, a substituted or unsubstituted aralkyl group, a substituted or unsubstituted alkoxy group, an alkyl- or aryl-substituted amino group, a substituted or unsubstituted acylamino group, a substituted or unsubstituted sulfonylamino group, a substituted or unsubstituted ureido group, a substituted or unsubstituted urethane group, a substituted or unsubstituted aryloxy group, a substituted or unsubstituted sulfamoyl group, a substituted or unsubstituted carbamoyl group, a substituted or unsubstituted aryl group, a substituted or unsubstituted alkylthio group, a substituted or unsubstituted arylthio group, a substituted or unsubstituted sulfonyl group, a substituted or unsubstituted sulfinyl group, a hydroxyl group, a halogen atom, a cyano group, a sulfo group, and a carboxyl group. Preferred among these is an ureido group. These substituents may, if possible, combine to form a ring.

$R^{21}$ preferably represents a substituted or unsubstituted aromatic group, a substituted or unsubstituted aromatic heterocyclic group or an aryl-substituted methyl group, and more preferably an aryl group, e.g., a phenyl group and a naphthyl group.

$R^{22}$ preferably represents a hydrogen atom, a substituted or unsubstituted alkyl group (e.g., a methyl group) or a substituted or unsubstituted aralkyl group (e.g., a hydroxybenzyl group), with a hydrogen atom being more preferred. The same substituents as recited for $R^{21}$ can be applied to $R^{22}$. Additional substituents for $R^{22}$ include an acyl group, an acyloxy group, an alkyl- or aryloxycarbonyl group, an alkenyl group, an alkynyl group, and a nitro group. These substituents for $R^{22}$ may further be substituted with a substituent selected from among the substituents mentioned above. If possible, these substituents may combine to form a ring.

$R^{21}$ or $R^{22}$, or inter alia $R^{21}$, can contain an antidiffusion group of couplers, etc., a so-called ballast group, which is preferably linked via a ureido group, or an adsorptive group $X^2(L^2)_m2$, wherein $X^2$ has the same meaning as $X^1$ in formula (N-I), and preferably is a thioamido group exclusive of a substituted or unsubstituted thiosemicarbazide, a mercapto group or a 5- or 6-membered nitrogen-containing heterocyclic group; $L^2$ has the same meaning as $L^1$ in formula (N-I); and $m^2$ represents 0 or 1.

$X^2$ preferably represents an acyclic thioamido group (e.g., a thioureido group, a thiourethane group, etc.), a cyclic thioamido group (i.e., a mercapto-substituted nitrogen-containing heterocyclic group, e.g., a 1-mercpatothiadiazole group, a 3-mercapto-1,2,4-triazole group, a 5-mercaptotetrazole group, a 2-mercapto-1,3,4-oxadiazole group, a 2-mercaptobenzoxazole group, etc.) or a nitrogen-containing heterocyclic group (e.g., a benzotriazole group, a benzimidazole group, an indazole group, etc.).

The most preferred group for $X^2$ varies depending on the type of light-sensitive material used. For example, in the case of color light-sensitive materials using a color former capable of coupling with an oxidation product of a p-phenylenediamine developing agent to form a dye (a so-called coupler), $X^2$ preferably represents a mercapto-substituted nitrogen-containing heterocyclic group or a nitrogen-containing heterocyclic group forming imino-silver.

In the case of color light-sensitive materials using a color former capable of cross-oxidizing an oxidation product of a developing agent to form a diffusible dye (a so-called DRR compound), $X^2$ preferably represents an acyclic thioamido group or a mercapto-substituted nitrogen-containing heterocyclic group.

In the case of black-and-white light-sensitive materials, $X^2$ preferably represents a mercapto-substituted nitrogen-containing heterocyclic group or a nitrogen-containing heterocyclic group forming imino-silver. $R^{23}$ or $R^{24}$ preferably represents a hydrogen atom. G preferably represents a carbonyl group.

It is preferable that the compounds represented by formula (N-II) contain an adsorptive group or a ureido group.

Examples of the compounds of formula (N-II) having an adsorptive group and processes for synthesizing them are described, e.g., in U.S. Pat. Nos. 4,040,925, 4,080,207, 4,031,127, 3,718,470, 4,269,929, 4,276,364, 4,278,748, 4,385,108, 4,459,347, 4,478,928, and 4,560,632, British Patent 2,011,391B, Japanese Patent Application (OPI) Nos. 74729/79, 163533/80, 74536/80, and 179734/85.

Examples of other hydrazine type nucleating agents of formula (N-II) and syntheses thereof are described, e.g., in Japanese Patent Application (OPI) No. 86829/82 and U.S. Pat. Nos. 4,560,638, 4,478,928, 2,563,785, and 2,588,982.

Specific, but non-limiting, examples of the compounds represented by formula (N-II) are shown below.

(N-II-1) 1-Formyl-2-{4-[3-(2-methoxyphenyl)ureido]-phenyl}-hydrazine (N-II-2) 1Formyl-2-{4-[3-[3-[3-(2,4-di-t-pentylphenoxy)-propyl]ureido]phenylsulfonylamino]phenyl}hydrazin (N-II-3) 1-Formyl-2-{4-[3-(5-mercaptotetrazol-1-yl)-benzamido]phenyl}hydrazine (N-II-4) 1-Formyl-2-[4-{3-[3-(5-mercaptotetrazol-yl)-phenyl]ureido}phenyl]hydrazine (N-II-5) 1-Formyl-2-[4-{3-[N-(5-merca-oto-4-methyl-1,2,4-triazol-3-yl)carbamoyl ]propanamido phenyl} hydrazine (N-II-6) 1-Formyl-2 4-[3-[N-[4-(3-mercapto-1,2,4-triazol4-yl)phenyl]carbamoyl]propanamido]phenyl} hydrazine (N-II-7) 1-Formyl-2-[4 3-[N-(5-mercapto-1,3,4-thiadiazol(2-yl)carbamoyl]propanamido}phenyl]hydrazine (N-II-8) 2-[4-(Benzotriazole-5-carboxamido)phenyl]-1-formylhydrazine (N-II-9) 2-[4-{3-[N-(Benzotriazole-5-carboxamido)carbamoyl]propaneamidc]phenyl]-1-formylhydrazine (N-II-10) 1-Formyl-2-{4-[1-(N-phenylcarbamoyl)thiosemicarbazido]phenyl}hydrazine (N-II-11) 1-Formyl-2-{4-[3-(3-phenylthioureido)benzamido]phenyl}hydrazine (N-II-12) 1-Formyl-2-[4-(3-hexylureido)phenyl]hydrazine The nucleating agent to be used in the present invention can be incorporated into a light-sensitive material or into a processing solution, and preferably the former.

In cases where the nucleating agent is incorporated into a light-sensitive material, it is preferably added to an internal latent image type silver halide emulsion layer. It may also be added to other layers, such as an intermediate layer, a subbing layer, a backing layer, etc., as long as it is diffused and adsorbed into silver halide grains during coating or processing.

In cases where the nucleating agent is incorporated into a processing solution, it can be added to a developing solution or a prebath having a low pH as described in Japanese Patent Application (OPI) No. 178350/83.

The total amount of the nucleating agents to be used ranges from $10^{-8}$ to $10^{-2}$ mol, and preferably from $10^{-7}$ to $10^{-3}$ mol, per mol of silver halide when added to a light-sensitive material; or from $10^{-5}$ to $10^{-1}$ mol, and preferably from $10^{-4}$ to $10^{-2}$ mol, per liter when added to a processing solution.

In addition to the nucleating agents, the following compounds can be added to a light-sensitive material and/or a processing solution for various purposes, such as increasing the maximum image density, decreasing the minimum image density,.improving preservability of the light-sensitive material, and accelerating development Hydroquinones (e.g., those described in U.S. Pat. Nos. 3,227,552 and 4,279,987;; chromans (e.g., those described in U.S. Pat. No. 4,268,621, Japanese Patent Application (OPI) No. 103031/79, *Research Disclosure*, No. 18264, pp. 333–334 (June, 1979)); quinones (e.g., those described in *Research Disclosure*, No. 21206, pp. 433–434 (December, 1981)); amines (e.g., those described in U.S. Pat. No. 4,150,993 and Japanese Patent Application (OPI) No. 174757/83); oxidizing agents (e.g., compounds described in Japanese Patent Application (OPI) No. 260039/85, *Research Disclosure*, No. 16936, pp. 10–11 (May, 1978)); catechols (e.g., those described in Japanese Patent Application (OPI) Nos. 21013/80 and 65944/80); compounds capable of releasing a nucleating agent during development (e.g., compounds described in Japanese Patent Application (OPI) No. 107029/85); thioureas (e.g!, those described in Japanese Patent Application (OPI) No. 985533/85); and spirobisindanes (e.g., those described in Japanese Patent Application (OPI) No. 65944/80).

Nucleation accelerators which can be used in combination with the nucleating agents include tetra-, tri- and pentaazaindenes having at least one mercapto group which may be arbitrarily substituted with an alkali metal atom or an ammonium group and the compounds disclosed in Japanese Patent Application Nos. 136948/86 (pp. 2–6 & 16–43), 136949/86 (pp. 12–43), and 15348/86 (pp. 10–29).

Specific but non-limiting examples of these nucleation accelerators are shown below.

(A-1l) 3-Mercapto-1,2,4-triazolo[4,5-a]pyridine (A-2) 3-Mercapto-1,2,4-triazolo[4,5-a]pyrimidine (A-3) 5-Mercapto-1,2,4-triazolo[4,5-a]pyrimidine (A-4) 7-(2-Dimethylaminoethyl)-5-mercapto-1,2,4-triazo[1,5-a]pyrimidine (A-5) 3-Mercapto-7-methyl-1,2,4-triazo[4,5-a]pyrimidine (A-6) 3,6-Dimercapto-1,2,4-triazolo[4,5-a]pyridazine (A-7) 2-Mercapto-5-methylthio-1,3,4-thiadiazole (A-8) 3-Mercapto-4-methyl-1,2,4-triazole (A-9) 2-(3-Dimethylaminopropylthio)-5mercapto-1,3,4-thiadiazole hydrochloride (A-10) 2-(2-Morpholinoethylthio)-5-mercapto-1,3,4-thiadiazole hydrochloride (A-11) 2-Mercapto-5-methylthiomethylthio-1,3,4-thiadiazole sodium salt (A-12) 4-(2-Morpholinoethyl)-3-mercapto-1,2,4-triazole (A-13) 2-[2-(2-Dimethylaminoethylthio)ethylthio]-5-mercapto-1,3,4-thiadiazole hydrochloride.

The nucleation accelerator can be incorporated into a light-sensitive material and/or a processing solution. It is preferable to incorporate it into silver halide emulsion layers or their neighboring layers. Two or more kinds of nucleation accelerators may be used in combination.

The amount of the nucleation accelerators to be added preferably ranges from $10^{-6}$ to $10^{-2}$ mol, and more preferably from $10^{-5}$ to $10^{-2}$ mol, per mol of silver halide.

When the nucleation accelerator is added to a processing solution, i.e., a developing solution or a prebath thereof, the amount preferably ranges from $10^{-8}$ to $10^{-3}$ mol, and more preferably from $10^{-7}$ to $10^{-4}$ mol, per liter.

The color developing solution to be used for development processing in the present invention contains substantially no silver halide solvent and is preferably an alkaline aqueous solution containing an aromatic primary amine color developing agent as a main component The color developing agent to be used includes aminophenol compounds and p-phenylenediamine compounds, with the latter compounds being preferred.

Typical examples of the p-phenylenediamine compounds are 3-methyl-4-amino-N-ethyl-N-(β-methanesulfonamidoethyl)-aniline, 3-methyl-4-amino-N-ethyl-N-(β-hydroxyethyl)aniline, 3-methyl-4-amino-N-ethyl-N-methoxyethylaniline and salts thereof, e.g., sulfates, hydrochlorides, etc.

In addition, color developing agents described in L. F. A. Mason, *Photographic Processing Chemistry*, 226-229, Focal Press (1966), U.S. Pat. Nos. 2,193,015 and 2,592,364, Japanese Patent Application (OPI) No. 64933/73, etc. may also be employed. If desired, two or more color developing agents may be used in combination.

These color developing agents are used in an amount of from 0.1 to 20 g, and preferably from 0.5 to 15 g, per liter of a developing solution.

The color developing solution usually contains a preservative, such as aromatic polyhydroxy compounds described in Japanese Patent Application (OPI) Nos. 49828/77, 47038/81, 32140/81, and 160142/84 and U.S. Pat. No. 3,746,544; hydroxyacetones described in U.S. Pat. Nos. 3,615,503 and British Patent 1,306,176; α-aminocarbonyl compounds described in Japanese Patent Application (OPI) Nos. 143020/77 and 89425/78; various metals described in Japanese Patent Application (OPI) Nos. 44148/82 and 53749/82; various sugars described in Japanese Patent Application (OPI) No. 102727/77; hydroxamic acids described in Japanese Patent Application (OPI) No. -27638/77; α,α'-dicarbonyl compounds described in Japanse Patent Application (OPI) No. 160141/84; salicylic acids described in Japanese Patent Application (OPI) No. 180588/84; alkanolamines described in Japanese Patent Applicat-ion (OPI) No. 3532/79; poly(alkyleneimines) described in Japanese Patent Application (OPI) No. 94349/81; gluconic acid derivatives described in Japanese Patent Application (OPI) No. 75647/81; and the like, either individually or in combinations of two or more thereof.

Of these preservatives, 4,5-dihydroxy-m-benzenedisulfonic acid, poly(ethyleneimine), and triethanolamine are preferred. In addition, substituted phenols, e.g., p-nitrophenol, are also preferred. Further, the alkylhydroxylamine compounds disclosed in Japanese Patent Application (OPI) No. 3532/79 are also preferred. In particular, the alkylhydroxylamine compounds are preferably combined with the above enumerated preservatives.

These preservatives are used usually in an amount of from 0.1 to 20 g, and preferably from 0.5 to 10 g, per liter of a developing solution.

The color developing solution to be used in this invention has a pH of 11.5 or lower, preferably from 9.5 to 11.2, and more preferably from 9.8 to 11.0. Maintenance of a pH within this range can be effected with various buffering agents, such as carbonates (e.g., potassium carbonate), phosphates (e.g , potassium phosphate), and the compounds described in Japanese Patent Application No. 32462/86, pp. 11-22.

The color developing solution can further contain various chelating agents for the purpose of preventing precipitation of calcium or magnesium or improving the stability of the solution. Examples of the chelating agents to be used are aminopolycarboxylic acids described in Japanese Patent Publication Nos. 30496/73 and 30232/69; organic phosphonic acids described in Japanese Patent Application (OPI) No. 97347/81, Japanese Patent Publication No. 39359/81, and West German Patent 2,227,639; phosphonocarboxylic acids described in Japanese Patent Application (OPI) Nos. 102726/77, 42730/78, 121127/79, 126241/80, and 65956/80; and other compounds as described in Japanese Patent Application (OPI) Nos. 195845/83 and 203440/83 and Japanese Patent Publication No. 40900/78. These chelating agents can be used, if desired, in combinations of two or more thereof. The chelating agent is added in an amount which is enough to block metal ions present in the color developing agent, for example, from about 0.1 to 10 g per liter.

If desired, the color developing solution can contain an arbitrary development accelerator. The development accelerators which can be added include thioether compounds described in Japanese Patent Publication Nos. 16088/62, 59878/62, 7826/63, 12380/69, and 9019/70; p-phenylenediamine compounds disclosed in Japanese Patent Application Nos. 49829/77 and 15554/75; quaternary ammonium salts described in Japanese Patent Application (OPI) No. 137726/75, Japanese Patent Publication No. 30074/69, and Japanese Patent Application (OPI) Nos. 156826/81 and 43429/77; p-aminophenols described in U.S. Pat. Nos. 2,610,122 and 4,119,462; amine compounds described in U.S. Pat. Nos. 2,494,903, 3,128,182, 4,230,796, and 3,253,919, Japanese Patent Publication No. 11431/66, and U.S. Pat. Nos. 2,482,546, 2,596,926, and 3,582,346; polyalkylene oxides described in Japanese Patent Publication Nos. 16088/62 and 25201/67, U.S. Pat. No. 3,128,183, Japanese Patent Publication Nos. 11431/66 and 23883/66, and U.S. Pat. No. 3,532,501; and, in addition, 1-phenyl-3-pyrazolidones, hydrazines, mesoionic compounds, thione compounds, imidazoles, and the like. Preferred of these are thioether compounds and 1-phenyl-3-pyrazolidones.

If desired, the color developing solution can further contain an arbitrary antifoggant. Usable antifoggants includes alkali metal halides, such as potassium bromide, sodium chloride, and potassium iodide; as well as organic antifoggants, such as nitrogen-containing heterocyclic compounds (e.g., benzotriazole, 6-nitrobenzimidazole, 5-nitrosoindazole, 5-methylbenzotriazol.e, 5-nitrobenzotriazole, 5-chlorobenzotriazole, 2-thiazolylbenzimidazole, 2-thiazolylmethylbenzimidazole, hydroxyazaindolidine, etc.), mercaptosubstituted heterocyclic compounds (e.g., 2-mercaptobenzimidazole, 2-mercaptobenzothiazole, etc.), adenine, and mercapto-substituted aromatic compounds (e.g., thiosalicylic acid, etc.). These antifoggants may be permitted to be of the type that dissolve out from the color light-sensitive materials during the processing and accumulate in the color developing solution, but from the standpoint of reducing the amount discharged as waste, the amount of accumulated anti-foggant is desirably as small as possible.

The color developing solution preferably contains a fluorescent brightening agent in an amount up to 5 g per liter, and preferably of from 0.1 g to 2 g per liter. Preferred examples of the fluorescent brightening agent are 4,4-diamino-2,2'-disulfostilbene compounds.

The color developing solution may further contain, if desired, various surface active agents, such as alkylphosphonic acids, arylphosphonic acids, aliphatic carboxylic acids, aromatic carboxylic acids, and the like.

After color development, the photographic emulsion layers are usually subjected to bleaching. Bleaching may be carried.out simultaneously with fixation in a blix monobath, or these two steps may be carried out separately. For speeding up processing, bleaching may be followed by blix, or fixation may be followed by blix.

Bleaching agents to be used in a bleaching or blix bath usually include aminopolycarboxylic acid iron complex salts.

Additives for the bleaching or blix bath are described in Japanese Patent Application No. 32462/86, pp. 22–30.

The blix or fixation (desilvering) is followed by washing and/or stabilization, etc. Washing or stabilization is preferably carried out by using softened water. A method for water softening is described, e.g., in Japanese Patent Application No. 131632/86, in which an ion-exchange resin or a back permeation apparatus is used. More specifically, the softening technique disclosed in Japanese Patent Application No. 131632/86 is preferred.

Additives to be used in the washing and stabilization steps are described, e.g., in Japanese Patent Application No. 32462/86, pp. 30–36.

In each of the aforesaid processing steps, the amount of replenisher is preferably as small as possible. More specifically, the amount is preferably from 0.1 to 50 times, and more preferably from 3 to 30 times, the amount of prebath that has been carried over per unit area of a lightsensitive material.

In cases of black-and-white light-sensitive materials, $X^2$ preferably represents a mercapto-substituted nitrogen-containing heterocyclic group or a nitrogen-containing heterocyclic group forming imino-silver.

For development of black-and-white light-sensitive materials, various known developing agents can be employed. Examples of such developing agents include polyhydroxybenzenes (e.g., hydroquinone, 2-chlorohydroquinone, 2-methylhydroquinone, catechol, pyrogallol, etc.), aminophenols (e.g., p-aminophenol, N-methyl-p-aminophenol, 2,4-diaminophenol, etc.), 3-pyrazolidones (e.g., 1-phenyl-3-pyrazolidones, 1-phenyl-4,4'-dimethyl-3-pyrazolidone, 1-phenyl-4-methyl-4-hydroxymethyl-3-pyrazolidone, 5,5-dimethyl-1-phenyl-3-pyrazolidone, etc.), ascorbic acids, and the like, either individually or in combinations thereof. In addition, the developing agents described in Japanese Patent Application No. 154116/81 can also be used.

These developing agents may be present either in an alkaline processing composition (processing element) or in an appropriate layer of a light-sensitive element.

The developing solution may contain, as a preservative, sodium sulfite, potassium sulfite, ascorbic acid, a reductone (e.g., piperidinohexose reductone), etc.

The light-sensitive material in accordance with the present invention is developed with a surface developer to obtain a direct positive. The surface developer acts on the latent image or fog nuclei on the surfaces of silver halide grains to thereby substantially induce a development reaction. Although the surface developer preferably contains no silver halide solvent, a silver halide solvent (e.g., a sulfite) may be present as long as it makes no substantial contribution to internal development until the development induced by the surface development centers completes.

The developer may contain sodium hydroxide, potassium hydroxide, sodium carbonate, potassium carbonate, sodium tertiary phosphate, sodium metaborate, etc. as an alkali agent or buffering agent. These agents are added in such an amount that the developer may have a pH of from 9 to 13, and preferably from 10 to 11.2.

The developer may further contain an antifoggant in order to ensure reduction of the minimum image density. Examples of the antifoggant to be added are benzimidazoles, e.g., 5-nitrobenzimidazole; and benzotriazoles, e.g., benzotriazole, 5-methylbenzotriazole, etc.

The details for the developing agents, preservatives, buffering agents, and the method for development for black-and-white light-sensitive materials are described in *Research Disclosure*, No. 17643, XIX-XXI (December, 1978).

When using DRR compounds, any silver halide developing agents or electron donors can be employed as long as it is capable of cross-oxidizing the DRR compounds. Such a developing agent may be incorporated into an alkaline developing solution (processing element) or an appropriate layer in the photographic element.

Examples of the developing agents which can be used in the present invention include hydroquinone and aminophenols, e.g., N-methylaminophenol, 1-phenyl-3-pyrazolidinone, 1-phenyl-4,4-dimethyl-3-pyrazolidinone, 1-phenyl-4-methyl-4-oxymethyl-3-pyrazolidinone, N,N-diethyl-p-phenylenediamine, 3-methyl-N,N-diethyl-p-phenylenediamine, 3-methoxy-N-ethoxy-p-phenylenediamine, etc. Among these developing agents, preferred are black-and-white developing agents which generally reduce stain formation in an image receiving layer (mordant layer) similar to the aforesaid alkaline developing solution.

When the present invention is applied to film units of the diffusion transfer type, it is preferable to process the light-sensitive material with a viscous developer. The viscous deyeloper is a liquid composition containing the components necessary for development of silver halide emulsions and formation of a diffusion transfer dye image and a solvent system consisting mainly of water and, if desired, hydrophilic solvents, e.g., methanol, methyl cellosolve, etc. In addition, the viscous developer preferably contains a high molecular weight hydrophilic polymer, e.g., polyvinyl alcohol, hydroxyethyl cellulose, sodium carboxymethyl cellulose, etc.

The hydrophilic polymer is suitably used in such an amount that the resulting processing composition may have a viscosity of at least 1 poise, and preferably from about 500 to about 1000 poises, at room temperature.

The above-described processing composition is preferably packed in a container destroyable upon application of pressure as disclosed in U.S. Pat. Nos. 2,543,181, 2,643,886, 2,653,732, 2,723,051, 3,056,491, 3,056,492, and 3,152,515.

The present invention will now be illustrated in greater detail by way of the following examples, but it should be understood that these examples are not deemed to limit the present invention. Unless otherwise indicated herein, all parts, percents, ratios and the like are by weight.

In these Examples, Emulsions A and B, Colloidal metallic sulfide,colloidal metal, and Colloidal Silver Sol A were prepared as follows.

Preparation of Emulsion A

A potassium bromide aqueous solution and a silver nitrate aqueous solution were simultaneously added to a gelatin aqueous solution containing 0.3 g of 3,4-dimethyl-1,3-thiazoline-2-thione per mol of silver at 75° C. over a period of about 20 minutes while vigorously stirring to obtain a mono-dispersed emulsion of octahedral silver bromide having a mean grain size of 0.4 μm. To the emulsion were added 10 mg of sodium thiosulfate and 10 mg of potassium chloroaurate (tetrahydrate) per mol of silver, and the system was heated at 75° C. for 60 minutes to effect chemical sensitization. The resulting silver bromide grains were used as a core and allowed to grow by further treating under the same precipitation conditions as above for 40 minutes to finally obtain a mono-dispersed emulsion of octahedral coreshell silver bromide having a mean grain size of 0.7 μm.

After washing with water and desalting, 3.0 mg of sodium thiosulfate and 3.0 mg of chloroauric acid (tetrahydrate) per mol of silver were added thereto, followed by heating at 50° C. for 60 minutes to effect chemical sensitization. There was obtained an internal latent image type silver halide emulsion (Emulsion A) having a coefficient of grain size variation of 10%.

Preparation of Emulsion B

A potassium bromide aqueous solution and a silver nitrate aqueous solution were simultaneously added to a gelatin aqueous solution containing 0.3 g of 3,4-dimethyl-1,3-thiazoline-2-thione per mol of silver at 75° C. over a period of about 20 minutes while vigorously stirring to obtain a mono-dispersed emulsion of octahedral silver bromide having a mean grain size of 0.4 μm. To the emulsion were added 6 mg of sodium thiosulfate and 6 mg of potassium chloroaurate (tetrahydrate) per mol of silver, and the system was heated at 75° C. for 80 minutes to effect chemical sensitization. The resulting silver bromide grains were used as a core and allowed to grow by further treating under the same precipitation conditions as above for 40 minutes to finally obtain a mono-dispersed emulsion of octahedral coreshell silver bromide having a mean grain size of 0.7 μm.

After washing with water and desalting, 1.5 mg of sodium thiosulfate and 1.5 mg of chloroauric acid (tetrahydrate) per mol of silver were added thereto, followed by heating at 57° C. for 40 minutes to effect chemical sensitizaon There was obtained an internal latent image type silver halide emulsion (Emulsion B) having a coefficient of grain size variation of 10%.

Preparation of Colloidal Metallic Sulfide

To 100 ml of a 2 wt % aqueous solution of phthalated gelatin was added 30 ml (0.01 mol) of nickel chloride while stirring and 6 ml (0.1 mol) of a nickel sulfide solution was further added thereto to prepare colloidal nickel sulfide sol.

In the same manner as described above, three additional colloidal sols, each containing one of palladium sulfide, silver sulfide and gold sulfide, were prepared from palladium chloride, silver nitrate or sodium chloroaurate, respectively.

Preparation of Colloidal Metal

To 100 ml of a 2 wt % aqueous solution of phthalated gelatin was added 10 ml of a 2N aqueous solution of sodium hydroxide, and 30 ml (0.01 mol) of palladium chloride was further added thereto while stirring. To the mixture was added 4 ml of a 0.1N aqueous solution of sodium boron hydride. The mixture was then cooled to 18° C. to gel the gelatin, followed by washing with running water for 5 hours to obtain colloidal palladium.

In the same manner as described above, colloidal gold or colloidal platinum was prepared from sodium chloroaurate or chloroplatinic acid, respectively.

| Preparation of Colloidal Silver Sol A: | | |
|---|---|---|
| Solution I: | Gelatin | 120 g |
| | Dextrin | 240 g |
| | Sodium hydroxide | 120 g |
| | Water | 20 l |
| Solution II: | Silver nitrate | 240 g |
| | Water | 2 l |
| Solution III: | Citric acid | 100 g |
| | Water | 560 ml |

Solution I was heated to 60° C., and Solution II was added thereto over 5 minutes while stirring. The stirring was continued for an additional 15 minutes while maintaining at 60° C. To the resulting mixture was added 2400 g of a 10 wt % gelatin aqueous solution, followed by stirring for 5 minutes. Solution III was then added thereto for neutralization. The mixture was washed with water and desalted in the usual manner to prepare a yellow colloidal silver sol (Sol A).

EXAMPLE 1

Multilayer color photographic papers having a layer structure shown below were prepared by coating a polyethylene-laminated (laminated on both sides) paper support using a core/shell type internal latent image emulsion A, having the following formulations in the order listed. The polyethylene layer on the side to be coated with the first layer containing a white pigment (e.g., $TiO_2$) and a bluing dye (e.g., ultramarine).

The coating compositions were prepared as follows:

Preparation of Coating Composition for lst Layer:

To a mixture of 10 g of Cyan Coupler (a) and 2.3 g of Dye Image Stabilizer (b) were added 10 ml of ethyl acetate and 4 ml of Solvent (c), shown below, to form a solution. The resulting solution was dispersed by emulsification in 90 ml of a 10 wt % gelatin aqueous solution containing 5 ml of a 10 wt % sodium dodecylbenzenesulfonate aqueous solution.

Separately, $2.0\times10^{-4}$ mol/mol-Ag of a red-sensitizing dye shown below was added to Emulsion A (Ag content: 70 g/Kg) to prepare 90 g of a red-sensitive emulsion.

The above-prepared coupler dispersion and the silver halide emulsion were mixed with a development accelerator and the gelatin concentration of the resulting composition was adjusted so as to have the indicated formulation. To the composition were further added $3.0\times10^{-5}$ mol/mol-Ag of Nucleating Agent (N-II-4) and $1.2\times10^{-4}$ mol/mol-Ag of Nucleation Accelerator (A-2) to prepare a coating composition for the 1st layer.

Coating compositions for the 2nd to 7th layers were prepared in a manner similar to that described above.

The amount of Colloidal Silver Sol A to be used in the 2nd layer is shown in Table 2 below. Each of these coating compositions additionally contained a sodium salt of 1-oxy-3,5-dichloro-s-triazine as a gelatin hardening agent.

Spectral sensitizing dyes used in the emulsion layers are shown below.

Sensitizing Dye for Red-Sensitive Layer:

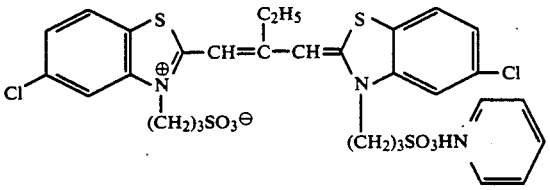

Sensitizing Dye for Green-Sensitizing Layer:

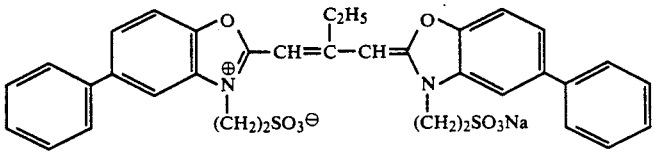

Sensitizing Dye for Blue-Sensitive Layer:

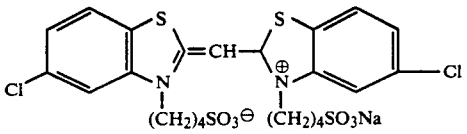

Anti-irradiation dyes used in the emulsion layers are shown below.

Anti-Irradiation Dye for Green-Sensitive Layer:

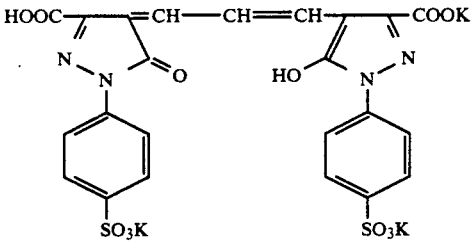

Anti-Irradiation Dye for Red-Sensitive Layer:

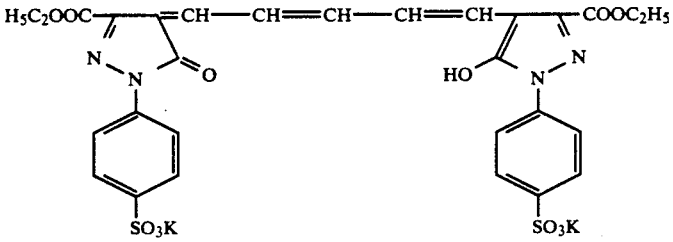

Layer Structure:

| | |
|---|---|
| Anti-Curling Layer: | |
| Gelatin | 2.70 g/m$^2$ |
| Support: | |
| Polyethylene-laminated paper | |
| 1st Layer (Red-Sensitive Layer): | |
| Emulsion A | 0.39 g of Ag/m$^2$ |
| Gelatin | 0.90 g/m$^2$ |

-continued

| | |
|---|---|
| Cyan Coupler (a) | $7.05 \times 10^{-4}$ mol/m$^2$ |
| Dye Image Stabilizer (b) | $5.20 \times 10^{-4}$ mol/m$^2$ |
| Solvent (c) | 0.22 g/m$^2$ |
| Development Accelerator (d) | 32 mg/m$^2$ |
| Nucleating Agent and Nucleation Accelerator | |
| 2nd Layer (Color Mixing Preventing Layer): | |
| Gelatin | 0.90 g/m$^2$ |
| Colloidal Silver Sol A | see Table 2 |
| Color Mixing Inhibitor (e) | $2.33 \times 10^{-4}$ mol/m$^2$ |
| 3rd Layer (Green-Sensitive Layer) | |
| Emulsion A | 0.39 g of Ag/m$^2$ |
| Gelatin | 1.56 g/m$^2$ |
| Magenta Coupler (f) | $4.60 \times 10^{-4}$ mol/m$^2$ |
| Dye Image Stabilizer (g) | 0.14 g/m$^2$ |
| Solvent (h) | 0.42 g/m$^2$ |
| Development Accelerator (d) | 32 mg/m$^2$ |
| Nucleating Agent and Nucleation Accelerator | |
| 4th Layer (Ultraviolet Absorbing Layer): | |
| Gelatin | 1.60 g/m$^2$ |
| Colloidal Silver Sol A | 0.10 g of Ag/m$^2$ |
| Ultraviolet Absorbent (i) | $1.70 \times 10^{-4}$ mol/m$^2$ |
| Color Mixing Inhibitor (j) | $1.60 \times 10^{-4}$ mol/m$^2$ |
| Solvent (k) | 0.24 g/m$^2$ |
| 5th Layer (Blue-Sensitive Layer): | |
| Emulsion A | 0.40 g of Ag/m$^2$ |
| Gelatin | 1.35 g/m$^2$ |
| Yellow Coupler (l) | $6.91 \times 10^{-4}$ mol/m$^2$ |
| Dye Image Stabilizer (m) | 0.13 g/m$^2$ |
| Solvent (h) | 0.02 g/m$^2$ |
| Development Accelerator (d) | 32 mg/m$^2$ |
| Nucleating Agent and Nucleating Accelerator | |
| 6th Layer (Ultraviolet Absorbing Layer): | |
| Gelatin | 0.54 g/m$^2$ |
| Ultraviolet Absorbent (i) | $5.10 \times 10^{-4}$ mol/m$^2$ |
| Solvent (k) | 0.08 g/m$^2$ |
| 7th Layer (Protective Layer): | |
| Gelatin | 1.33 g/m$^2$ |
| Polymethyl methacrylate latex (average particle size: 2.8 μm) | 0.05 g/m$^2$ |
| Acryl-modified polyvinyl alcohol copolymer (degree of modification: 17%) | 0.17 g/m$^2$ |

The chemical structures of the compounds used in the same preparation are as follows:

(a) Cyan Coupler:

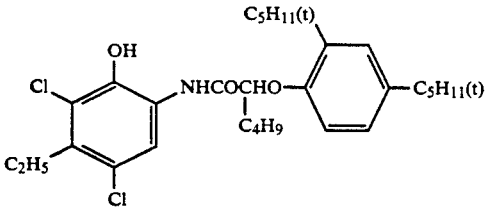

(b) Dye Image Stabilizer: A 1:3:3 molar ratio mixture of

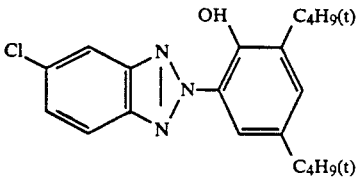

-continued
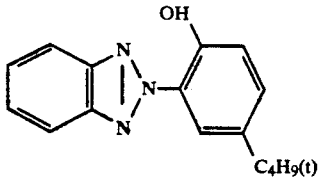
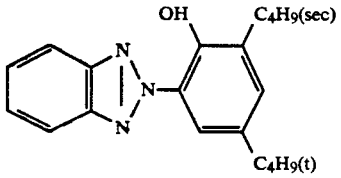
respectively.
(c) Solvent:
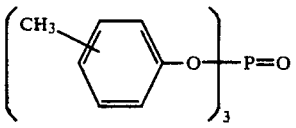
(d) Development Accelerator:
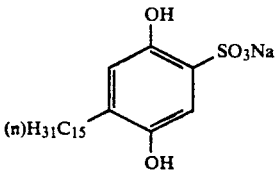
(e) Color Mixing Inhibitor:
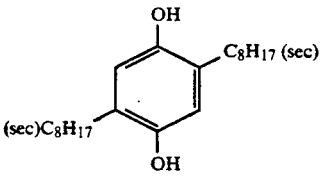
(f) Magenta Coupler:
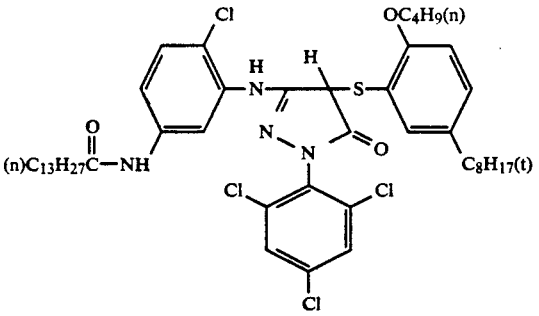
(g) Dye Image Stabilizer: A 1:1.5 weight ratio mixture of
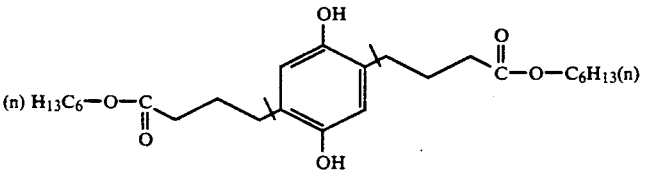
and -continued
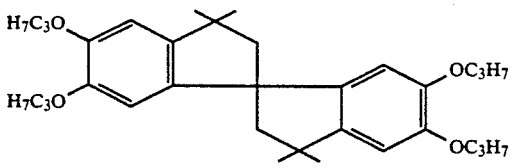
respectively.
(h) Solvent: A 1:2:2 weight ratio mixture of
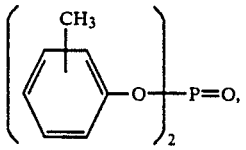
$((n)C_8H_{17}O)_3P{=}O$,
and
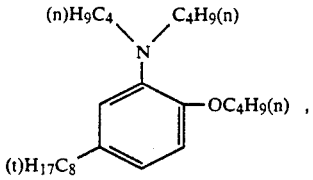
respectively.
(i) Ultraviolet Absorbent: A 1:5:3 molar ratio mixture of
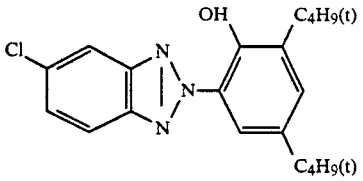
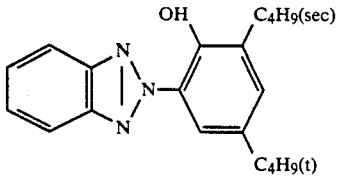
and
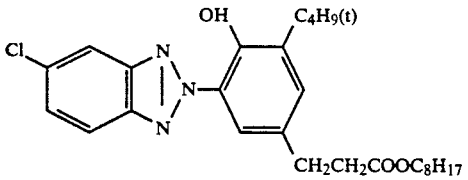
respectively.
(j) Color Mixing Inhibitor:
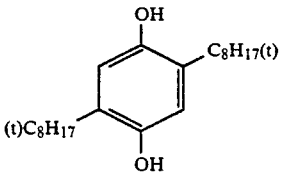
(k) Solvent:
$(iso\text{-}C_9H_{19}O)_3P{=}O$
(l) Yellow Coupler:

-continued

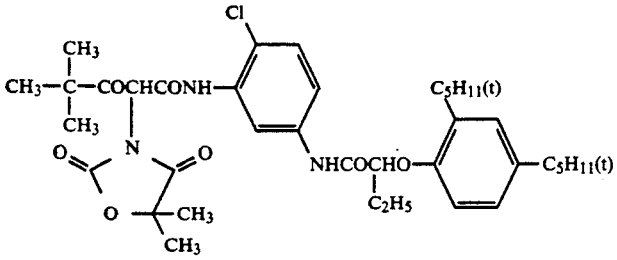

(m) Dye Image Stabilizer:

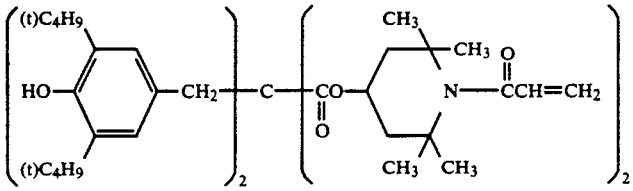

The thus prepared photographic papers containing 0.20, 0.04, 0.01, 0.003 and 0 g Ag/m$^2$ Silver Sol A in the 2nd Layer (see Table 2) were designated as Sample 101 to 105, respectively. Each of Samples 101 to 105 was wedgewise exposed to light at an exposure of 10 CMS for 1/10 second and then subjected to development processing according to the procedure shown in Table 1 below.

TABLE 1

| Processing Step | Temperature | Time |
|---|---|---|
| Color Development | 35° C. | 1'30" |
| Blix | 35° C. | 40" |
| Stabilization (1) | 35° C. | 20" |
| Stabilization (2) | 35° C. | 20" |
| Stabilization (3) | 35° C. | 20" |

Stabilization was carried out using a counter-current replenishment system in which a replenisher was fed to the stabilization bath (3), introducing an overflow of stabilization bath (3) to stabilization bath (2), and introducing an overflow of stabilization bath (2) to stabilization bath (1).

The processing solutions used in the processing steps had the following formulations. The color developer had been fatigued through use in a development process running for 16 hours with the color developer at 35° C. before use.

| | |
|---|---|
| Formulation of Color Developer: | |
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N-ethyl-N-(β-methanesulfonamidoethyl)-aniline | 4.25 g |
| Potassium carbonate | 30.0 g |
| Stilbene type fluorescent brightening agent | 1.0 g |
| Water to make | 1000 ml |
| Potassium hydroxide or hydrochloric acid to adjust to | pH = 10.20 |
| Formulation of Blix Bath: | |
| Ammonium thiosulfate | 110 g |
| Sodium hydrogen sulfite | 10 g |
| Ammonium (diethylenetriaminepentaacetato)iron (III) monohydrate | 56 g |

-continued

| | |
|---|---|
| Disodium ethylenediaminetetraacetate dihydrate | 5 g |
| 2-Mercapto-1,3,4-triazole | 0.5 g |
| Water to make | 1000 ml |
| Aqueous ammonia or hydrochloric acid to adjust to | pH = 6.5 |
| Formulation of Stabilization Bath: | |
| 1-Hydroxyethylidene-1,1'-disulfonic acid (60%) | 1.6 ml |
| Bismuth chloride | 0.35 g |
| Polyvinylpyrrolidone | 0.25 g |
| Aqueous ammonia (28%) | 2.5 ml |
| Trisodium nitrilotriacetate | 1.0 g |
| 5-Chloro-2-methyl-4-isothiazolin-3-one | 50 mg |
| 2-Octyl-4-isothiazolin-3-one | 50 mg |
| 4,4'-Diaminostilbene type fluorescent brightening agent | 1.0 g |
| Water to make | 1000 ml |
| Potassium hydroxide or hydrochloric acid to adjust to | pH = 7.5 |

The above specified processing was designated as Processing A.

The same procedure was repeated, except for changing the pH of the color developer to 11.2 and changing the color development time to 1 minute (Processing B) and changing the pH of the color developer to 12.0 and changing the color development time to 1 minute (Processing C).

Each of the resulting cyan dye images was evaluated for graininess according to the followign rating. The results obtained are shown in Table 2 below.

| Graininess Rating: |
|---|
| 5 . . . Excellent |
| 4 . . . Good |
| 3 . . . Normal |
| 2 . . . Slightly poor |
| 1 . . . Poor |

TABLE 2

| Sample No. | Amount of Sol A (Ag Amount) in 2nd Layer (g/m$^2$) | Graininess of Cyan Image Processing A | Processing B | Processing C |
|---|---|---|---|---|
| 101 | 0.20 | 4 | 4 | 4 |
| 102 | 0.04 | 4 | 4 | 4 |

TABLE 2-continued

| Sample No. | Amount of Sol A (Ag Amount) in 2nd Layer ($g/m^2$) | Graininess of Cyan Image Processing A | Processing B | Processing C |
|---|---|---|---|---|
| 103 | 0.01 | 4 | 4 | 4 |
| 104 | 0.003 | 4 | 4 | 4 |
| 105 | 0 | 1 | 2 | 4 |

As can be seen from Table 2, when development processing is carried out at a high pH of 12, all of Samples 101 to 105 show satisfactory image graininess without making any difference. However, Samples 101 to 104 exhibit superiority in graininess over Sample 105 when processed at lower pH values.

Further, Samples 101 to 104 each had a higher maximum image density than Sample 105.

Since each of Samples 101 to 105 contained colloidal silver also serving as a filter in the 4th layer, their magenta and yellow images had satisfactory graininess rated as "4" and satisfactorily high maximum density irrespective of the development conditions.

COMPARATIVE EXAMPLE

Color photographic papers were produced in the same manner as described in Example 1, except for excluding the nucleating agent and nucleation accelerator. The resulting samples were processed according to Processing A of Example 1, except for changing the development time of 2 minutes and 20 seconds and subjecting the material during the color development,-step to fog exposure (0.5 lux on the film-surface; color temperature: 5400° K.) for 5 seconds after 15 seconds from the start of the development.

No difference in graininess was observed and there was no difference in maximum image density between those samples containing colloidal silver in the 2nd layer and those samples containing no colloidal silver in the 2nd layer.

EXAMPLE 2

Color photographic papers were produced in the same manner as in Example 1, except that a gelatin layer (0.9 $g/m^2$) was additionally provided between the support and the lst layer and Colloidal Silver Sol A was added to this gelatin layer in place of the 2nd layer. Each of the resulting samples was processed in the same manner as in Example 1 to obtain a positive color image. The results obtained were equal to those of Example 1.

EXAMPLE 3

Positive color images were obtained in the same manner as in Example 1, except for excluding the nucleation accelerator, replacing (N-II-4) with a nucleating agent as shown in Table 3 below, and changing the color development time in Processing A, B or C to 2 and a half minute, 2 minutes or 2 minutes, respectively.

The results obtained were equal to those in Example 1.

TABLE 3

| Nucleating Agent | Amount (mol/mol Ag) |
|---|---|
| N-II-1 | $5.6 \times 10^{-4}$ |
| N-II-2 | $5.6 \times 10^{-4}$ |
| N-II-5 | $5.6 \times 10^{-5}$ |
| N-II-7 | $5.6 \times 10^{-5}$ |
| N-II-9 | $5.6 \times 10^{-5}$ |

EXAMPLE 4

Positive color images were obtained in the same manner as in Example 1, except for excluding the.nucleation accelerator, replacing (N-II-4) with $5.6 \times 10^{-6}$ mol/-mol-Ag of (N-I-1), (N-I-2), (N-I-5), (N-I-6), (N-I-7), (N-I-8) or (N-I-9), and changing the color development time of Processing A, B or C to 2 minutes and 20 seconds, 1 minute and 50 seconds, or 1 minute and 50 seconds, respectively The same results as in Example 1 were obtained.

EXAMPLE 5

The same procedure of Example 3 was repeated, except for adding Colloidal Silver Sol A to the lst layer (red-sensitive layer) and replacing Cyan Coupler (a) with a cyan coupler of formula

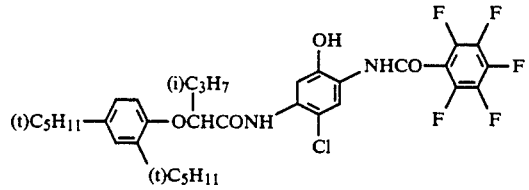

The same results as in Example 1 were obtained.

EXAMPLE 6

Multilayer color photographic papers were produced in the same manner as in Example 1, except for replacing (N-II-4) with $1.5 \times 10^{-5}$ mol/mol-Ag of (N-II-6), replacing (A-4 2) with $3.5 \times 10^{-4}$mol/mol-Ag of (A-9), changing the silver amount of Colloidal Silver Sol A to be added to the 2nd layer as shown in Table 6, and making other changes as indicated in Table 5 below.

TABLE 5

| Layer | Before Alteration | After Alteration Kind | Amount |
|---|---|---|---|
| 1st | Cyan Coupler (a) | (a-2) | $7.05 \times 10^{-4}$ mol/$m^2$ |
| 3rd | Emulsion A | same | 0.17 g of Ag/$m^2$ |
| | Magenta Coupler (f) | (f-2) | $3.38 \times 10^{-4}$ mol/$m^2$ |
| | Dye Image Stabilizer (g) | (g-2) | 0.19 g/$m^2$ |
| | Solvent (h) | (h-2) | 0.59 g/$m^2$ |
| 5th | Yellow Coupler (l) | (l-2) | $6.91 \times 10^{-4}$ mol/$m^2$ |

(a-2) Cyan Coupler: A 1:1 molar ratio mixture of

TABLE 5-continued

| Layer | Before Alteration | After Alteration Kind | Amount |
|---|---|---|---|

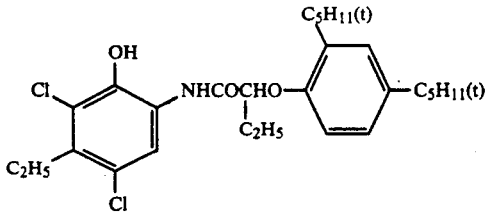

and

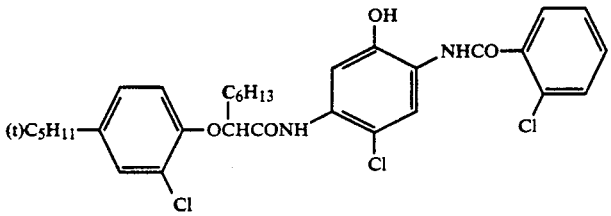

respectively.

(f-2) Magenta Coupler:

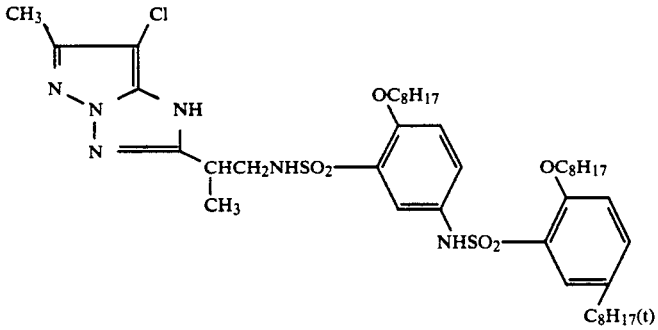

(g-2) Dye Image Stabilizer:

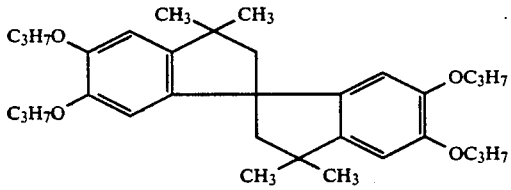

(h-2) Solvent: A 2:1 weight ratio mixture of

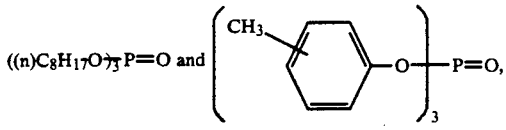

respectively.

Each of the resulting samples (Samples 601 to 606) was preserved in an atmosphere of 45° C. and 80% RH for 3 days (incubation) and then subjected to Processing A, B or C as described in Example 1. The graininess of the resulting image was evaluated in the same manner as in Example 1.

TABLE 6

| Sample No. | Amount of Sol A (Ag Amount) in 2nd Layer ($g/m^2$) | Graininess of Cyan Image Processing A | Processing B | Processing C |
|---|---|---|---|---|
| 601 | 0.35 | 4 | 4 | 4 |
| 602 | 0.10 | 4 | 4 | 4 |
| 603 | 0.05 | 4 | 4 | 4 |
| 604 | 0.01 | 4 | 4 | 4 |

TABLE 6-continued

| Sample No. | Amount of Sol A (Ag Amount) in 2nd Layer ($g/m^2$) | Graininess of Cyan Image Processing A | Processing B | Processing C |
|---|---|---|---|---|
| 605 | 0.003 | 4 | 4 | 4 |
| 606 | 0 | 1 | 2 | 4 |

As can be seen from Table 6, although Samples 601 to 606 containing colloidal silver in the 2nd layer show no difference from Sample 606 containing no colloidal silver in the 2nd layer when processed at a pH of 12, they exhibit superior graininess over Sample 606 when processed at a low pH after being incubated. Further, Sample 601 to 605 did not undergo formation of a re-reversal negative image to the same extent as Sample 606.

EXAMPLE 7

The same procedure of Example 6 was repeated, except for adding Colloidal Silver Sol A to the 1st layer (redsensitive layer) instead of the 2nd layer. The results obtained were equal to those of Example 6.

EXAMPLE 8

The same procedure of Example 6 was repeated, except for additionally providing a gelatin layer (0.50 $g/m^2$) between the 1st and 2nd layers and replacing Magenta Coupler (f-2) with a magenta coupler of the formula:

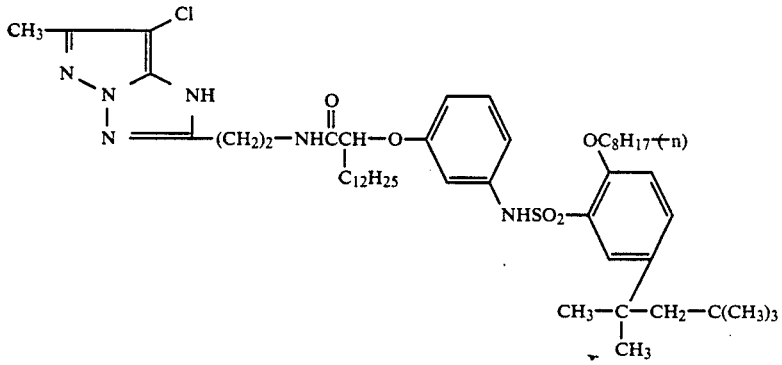

The results obtained were equal to those of Example 6.

EXAMPLE 9

The same procedure of Example 6.was repeated, except for replacing (N-II-6) with $3.7\times10^{-7}$ mol/mol-Ag of (N-I-5) and replacing (A-9) with the same amount of (A-1), (A-2), (A-3), (A-4), (A-8), (A-10), (A-11), (A-12), (A-13) or (A-6) or using the same amount of (A-9) as before. The results obtained were equal to those of Example 6.

EXAMPLE 10

The same procedure of Example 9 was repeated, except for replacing (N-I-5) with the same amount of (N-I-9) or (N-I-10). The results obtained were equal to those of Example 9.

EXAMPLE 11

The same procedure of Example 9 was repeated, except for replacing (N-I-5) with $4.5\times10^{-6}$ mol/mol-Ag of (N-II-3), (N-II-7) or (N-II-9). The results obtained were equal to those of Example 9.

As described above, the present invention makes it possible to form a direct positive having satisfactory graininess as well as high color density by processing an internal latent image type silver halide light-sensitive material, which has not been previously fogged, in the presence of a nucleating agent with a surface color developing solution even at a low pH. Such an effect holds out even in cases where the light-sensitive materials are continuously processed or preserved under severe conditions.

EXAMPLE 12

Multilayer color photographic papers having a layer structure shown below were prepared by coating a polyethylene-laminated (laminated on both sides) paper support using a core/shell type internal latent image emulsion B, having the following formulations in the order listed. The polyethylene layer on the side to be coated with the first layer containing a white pigment (e.g., $TiO_2$) and a bluing dye (e.g., ultramarine).

The coating compositions were prepared as follows:

Preparation of Coating Composition for 1st Layer:

To a mixture of 10 g of Cyan Coupler (a) and 2.3 g of Dye Image Stabilizer (b) were added 10 ml of ethyl acetate and 4 ml of Solvent (c), shown below, to form a solution. The resulting solution was dispersed by emulsification in 90 ml of a 10 wt % gelatin aqueous solution containing 5 ml of a 10 wt % sodium dodecylbenzenesulfonate aqueous solution.

Separately, $2.0\times10^{-4}$ mol/mol-Ag of a red-sensitizing dye shown below was added to Emulsion A (Ag content: 70 g/Kg) to prepare 90 g of a red-sensitive emulsion.

The above-prepared coupler dispersion and the silver halide emulsion were mixed with a development accelerator and the gelatin concentration of the resulting composition was adjusted so as to have the indicated formulation. To the composition was further added $2.5\times10^{-5}$ mol/mol-Ag of Nucleating Agent (N-II-4) and $3.5\times10^{-4}$ mol/mol-Ag of Nucleating Accelerator (A-5) to prepare a coating composition for the 1st layer.

Coating compositions for the 2nd to 7th layers were prepared in a manner similar to that described above. The amount of Colloidal Silver Sol A to be used in the 2nd layer is shown in Table 2 below. Each of these coating compositions additionally contained, a sodium salt of 1-oxy-3,5-dichloro-s-triazine as a gelatin hardening agent.

Spectral sensitizing dyes used in the emulsion layers are shown below.

Sensitizing Dye for Red-Sensitive Layer:

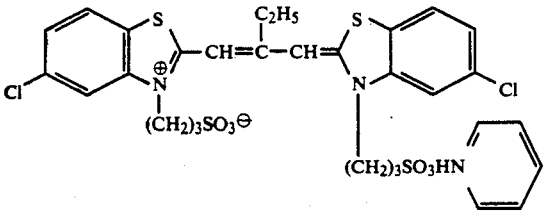

Sensitizing Dye for Green-Sensitizing Layer:

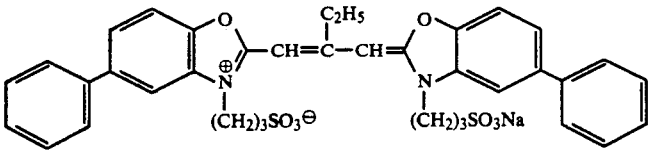

Sensitizing Dye of Blue-Sensitive Layer:

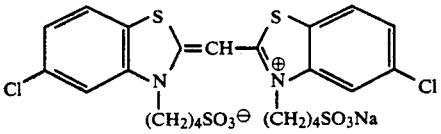

Anti-irradiation dyes used in the emulsion layers are shown below.

Anti-Irradiation Dye for Green-Sensitive Layer:

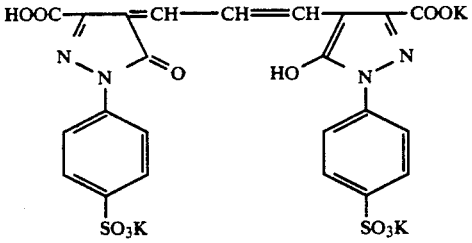

Anti-Irradiation Dye for Red-Sensitive Layer:

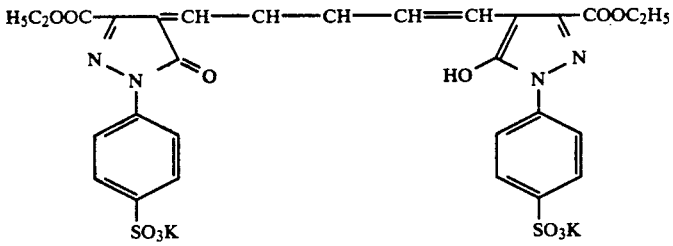

Layer Structure:

| | |
|---|---|
| Anti-Curling Layer: | |
| Gelatin | 2.70 g/m$^2$ |
| Support: | |
| Polyethylene-laminated paper | |
| 1st Layer (Red-Sensitive Layer): | |
| Emulsion B | 0.39 g of Ag/m$^2$ |
| Gelatin | 0.90 g/m$^2$ |
| Cyan Coupler (a) | $7.05 \times 10^{-4}$ mol/m$^2$ |
| Dye Image Stabilizer (b) | $5.20 \times 10^{-4}$ mol/m$^2$ |
| Solvent (c) | 0.22 g/m$^2$ |
| Development Accelerator (d) | 32 mg/m$^2$ |
| Nucleating Agent and | |
| Nucleation Accelerator | |
| 2nd Layer (Color Mixing Preventing | |

-continued

| | |
|---|---|
| Layer): | |
| Gelatin | 0.90 g/m$^2$ |
| Color Mixing Inhibitor (e) | 2.33 × 10$^{-4}$ mol/m$^2$ |
| 3rd Layer (Green-Sensitive Layer) | |
| Emulsion B | 0.39 g of Ag/m$^2$ |
| Gelatin | 1.56 g/m$^2$ |
| Magenta Coupler (f) | 4.60 × 10$^{-4}$ mol/m$^2$ |
| Dye Image Stabilizer (g) | 0.14 g/m$^2$ |
| Solvent (h) | 0.42 g/m$^2$ |
| Development Accelerator (d) | 32 mg/m$^2$ |
| Nucleating Agent and Nucleation Accelerator | |
| 4th Layer (Ultraviolet Absorbing Layer): | |
| Gelatin | 1.60 g/m$^2$ |
| Colloidal Silver Sol A | 0.10 g of Ag/m$^2$ |
| Ultraviolet Absorbent (i) | 1.70 × 10$^{-4}$ mol/m$^2$ |
| Color Mixing Inhibitor (j) | 1.60 × 10$^{-4}$ mol/m$^2$ |
| Solvent (k) | 0.24 g/m$^2$ |
| 5th Layer (Blue-Sensitive Layer): | |
| Emulsion B | 0.40 g of Ag/m$^2$ |
| Gelatin | 1.35 g/m$^2$ |
| Yellow Coupler (l) | 6.91 × 10$^{-4}$ mol/m$^2$ |
| Dye Image Stabilizer (m) | 0.13 g/m$^2$ |
| Solvent (h) | 0.02 g/m$^2$ |
| Development Accelerator (d) | 32 mg/m$^2$ |
| Nucleating Agent and Nucleating Accelerator | |
| 6th Layer (Ultraviolet Absorbing Layer): | |
| Gelatin | 0.54 g/m$^2$ |
| Ultraviolet Absorbent (i) | 5.10 × 10$^{-4}$ mol/m$^2$ |
| Solvent (k) | 0.08 g/m$^2$ |
| 7th Layer (Protective Layer): | |
| Gelatin | 1.33 g/m$^2$ |
| Polymethyl methacrylate latex (average particle size: 2.8 m) | 0.05 g/m$^2$ |
| Acryl-modified polyvinyl alcohol copolymer (degree of modification: 17%) | 0.17 g/m$^2$ |

The chemical structures of the compounds used in the same preparation are as follows:

(a) Cyan Coupler:

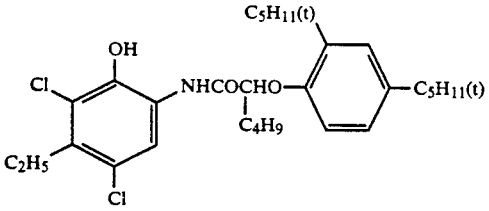

(b) Dye Image Stabilizer: A 1:3:3 molar ratio mixture of

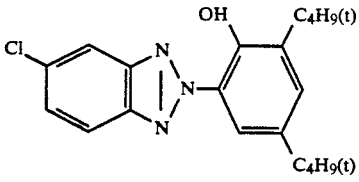

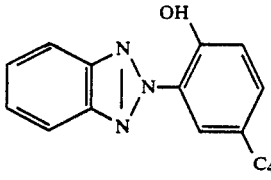

-continued

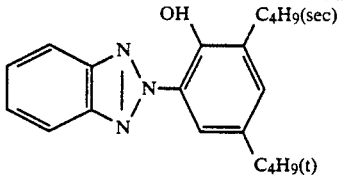

respectively.

(c) Solvent:

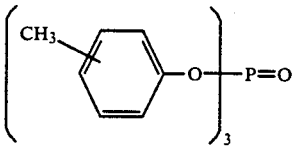

(d) Development Accelerator:

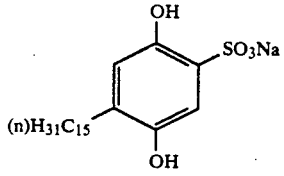

(e) Color Mixing Inhibitor:

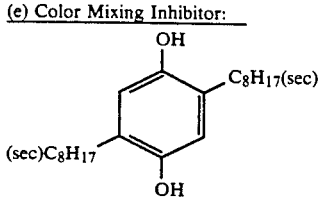

-continued (f) Magenta Coupler:

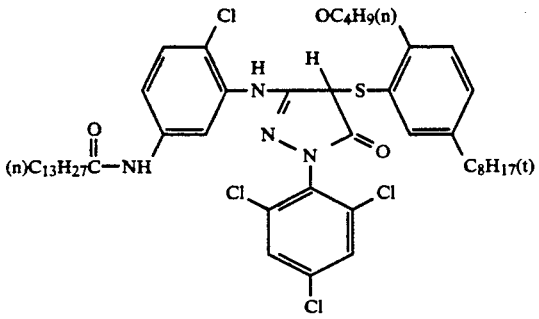

(g) Dye Image Stabilizer: A 1:1 weight ratio mixture of

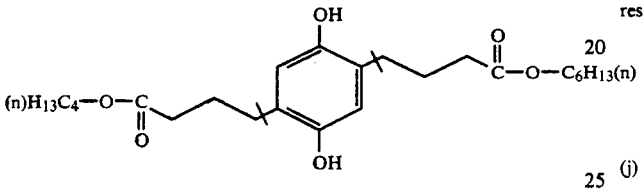

and

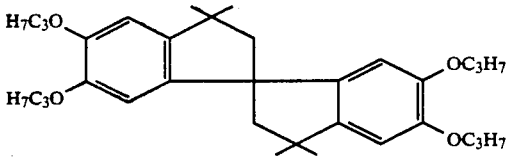

respectively.

(h) Solvent: A 1:2:2 weight ratio mixture of

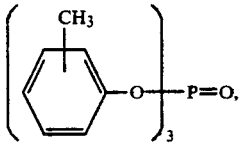

((n)CJD $8H_{17}O)_3P{=}O$, and

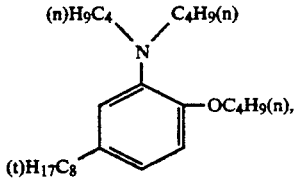

respectively.

(i) Ultraviolet Absorbent: A 1:5:3 molar ratio mixture of

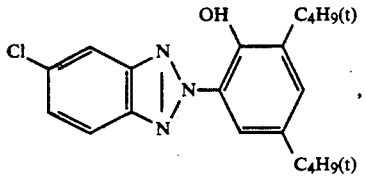

-continued

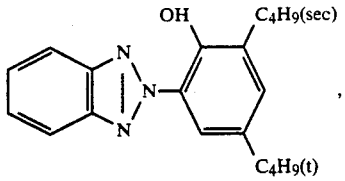

and

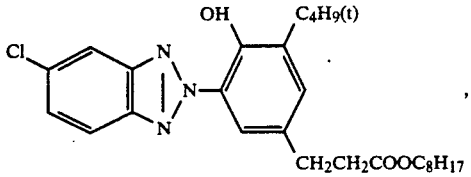

respectively.

(j) Color Mixing Inhibitor:

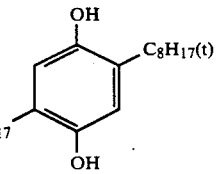

(k) Solvent:

(iso-$C_9H_{19}O)_3P{=}O$ (l) Yellow Coupler:

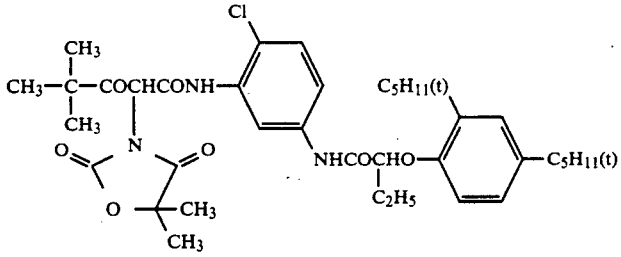

(m) Dye Image Stabilizer:

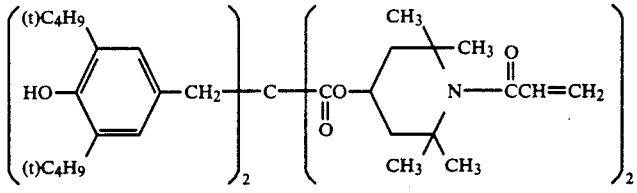

Samples thus formed were wedgewise exposed to light at an exposure of 10 CMS for 1/10 second and then subjected to development processing according to the procedure shown in Table 7 below.

TABLE 7

| Processing Step | Temperature | Time |
|---|---|---|
| Color Development | 35° C. | 1'50" |
| Blix | 35° C. | 1'10" |
| Stabilization (1) | 35° C. | 40" |
| Stabilization (2) | 35° C. | 40" |
| Stabilization (3) | 35° C. | 40" |

Stabilization was carried out using a counter-current replenishment system in which a replenisher was fed to the stabilization bath (3), introducing an overflow of stabilization bath (3) to stabilization bath (2), and introducing an overflow of stabilization bath (2) to stabilization bath (1).

| Formulation of Color Developer: | |
|---|---|
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N-ethyl-N-(β-methanesulfonamidoethyl)-aniline | 4.25 g |
| Potassium carbonate | 30.0 g |
| Stilbene type fluorescent brightening agent | 1.0 g |
| Water to make | 1000 ml |
| Potassium hydroxide or hydrochloric acid to adjust to | pH = 10.20 |
| Formulation of Blix Bath: | |
| Ammonium thiosulfate | 110 g |
| Sodium hydrogen sulfite | 10 g |
| Ammonium (diethylenetriaminepentaacetato)iron (III) monohydrate | 56 g |
| Disodium ethylenediaminetetraacetate dihydrate | 5 g |
| 2-Mercapto-1,3,4-triazole | 0.5 g |
| Water to make | 1000 ml |
| Aqueous ammonia or hydrochloric acid to adjust to | pH = 6.5 |
| Formulation of Stabilization Bath: | |
| 1-Hydroxyethylidene-1,1'-disulfonic acid (60%) | 1.6 ml |
| Bismuth chloride | 0.35 g |
| Polyvinylpyrrolidone | 0.25 g |
| Aqueous ammonia (28%) | 2.5 ml |
| Trisodium nitrilotriacetate | 1.0 g |
| 5-Chloro-2-methyl-4-isothiazolin-3-one | 50 mg |
| 2-Octyl-4-isothiazolin-3-one | 50 mg |
| 4,4'-Diaminostilbene type fluorescent brightening agent | 1.0 g |
| Water to make | 1000 ml |
| Potassium hydroxide or hydrochloric acid to adjust to | pH = 7.5 |

The above specified processing was designated as Processing A.

TABLE 8

| Colloidal Metal (added to 2nd Layer) Kind | Amount (mol/m²) | Maximum Cyan Density |
|---|---|---|
| Metallic palladium | $1.2 \times 10^{-5}$ | 2.4 |
| Metallic palladium | $1.2 \times 10^{-6}$ | 2.4 |
| Metallic palladium | $1.2 \times 10^{-7}$ | 2.4 |
| Metallic palladium | $1.2 \times 10^{-8}$ | 2.4 |
| Metallic palladium | $1.2 \times 10^{-9}$ | 2.3 |
| Palladium sulfide | $1.2 \times 10^{-5}$ | 2.4 |
| Palladium sulfide | $1.2 \times 10^{-7}$ | 2.4 |
| Palladium sulfide | $1.2 \times 10^{-9}$ | 2.3 |
| Metallic gold | $1.2 \times 10^{-7}$ | 2.4 |
| Metallic platinum | $1.2 \times 10^{-7}$ | 2.4 |
| None | — | 1.7 |

When the same procedure as above was repeated, except for using silver sulfide, gold sulfide or nickel sulfide, the results obtained were equal.

When the pH of the color developer was changed to 12.0, the maximum cyan densities obtained with the colloidal metal according to the present invention being added to the 2nd layer were significantly higher than those containing no colloidal metal. However, in cases where colloidal silver was used, the maximum cyan density obtained at a pH of 1.20 showed no improvement over that obtained without using colloidal silver.

Further, irrespective of the pH of the developer, incorporation of colloidal silver into the 2nd layer resulted in an increase of minimum image density, whereas the colloidal metal (or metallic sulfide) according to the present invention did not cause such an adverse effect.

EXAMPLE 13

Multilayer color photographic papers were prepared in the same manner as in Example 12, except that the kind and amount of compounds in the 5th, 3rd and lst layers were varied according to Table 9 below and the kind and amount of metals was varied according to Table 10 below.

TABLE 9

| Layer | Compositions | Amount |
|---|---|---|
| 5th Layer (Blue Sensitive) | Yellow Coupler (l-2) | $6.91 \times 10^{-4}$ mol/m² |
| 3rd Layer (Green Sensitive | Emulsion A | 0.17 g/m² |
| | Magenta Coupler (f-2) | $3.38 \times 10^{-4}$ mol/m² |
| | Image Stabilizer (g-2) | 0.19 g/m² |
| | Solvent (h-2) | 0.59 g/m² |
| 1st Layer (Red Sensitive) | Cyan Coupler (a-2) | $7.05 \times 10^{-4}$ mol/m² |

(a-2) Cyan Coupler: A 1:1 molar ratio mixture of

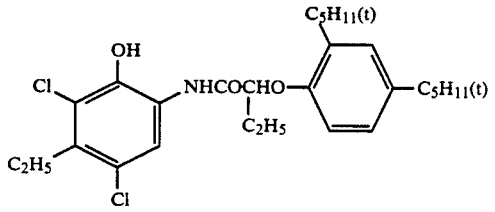

and

TABLE 9-continued

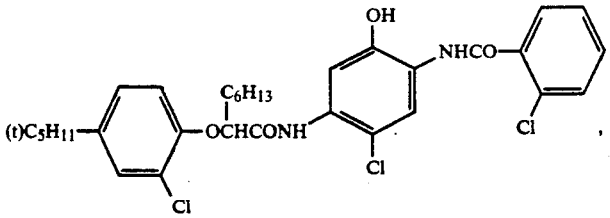

respectively.

(f-2) Magenta Coupler:

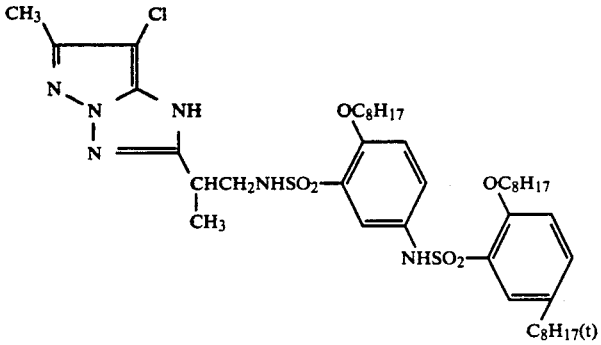

(g-2) Image Stabilizer:

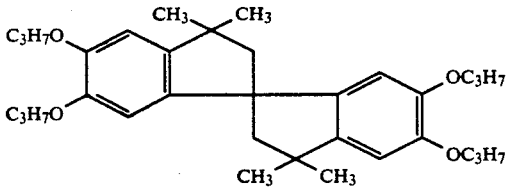

(h-2) Solvent: A 2:1 weight ratio mixture of

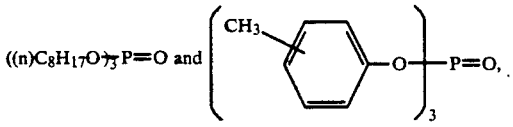

respectively.

(l-2) Yellow Coupler:

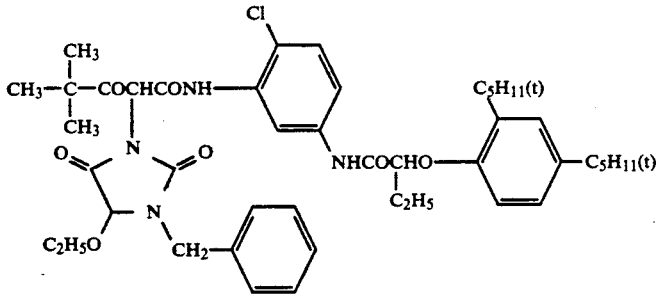

(N-I-5) and (A-13) were used in an amount of $1.5\times10^{-6}$ mol and $5.6\times10^{-4}$ mol, respectively, per mol of silver.

The light-sensitive material was processed in the same manner as in Example 12, except for changing the amount of sodium bromide in the color developer formulation of 0.60 g/l. The resulting direct color positive was evaluated for cyan graininess. The results obtained are shown in Table 10 below.

TABLE 10

| Colloidal Metal | | |
|---|---|---|
| Kind | Amount (mol/m$^2$) | Graininess |
| Palladium sulfide | $1.2\times10^{-5}$ | 4 |
| Palladium sulfide | $1.2\times10^{-7}$ | 4 |

TABLE 10-continued

| Colloidal Metal | | |
|---|---|---|
| Kind | Amount (mol/m$^2$) | Graininess |
| Palladium sulfide | $1.2 \times 10^{-9}$ | 4 |
| None | — | 1 |

It can be seen from the above results that the graininess of the cyan image can clearly be improved by incorporating palladium sulfide into the 2nd layer.

When the same procedure was repeated, except for replacing palladium sulfide with metallic palladium, metallic gold, metallic platinum, silver sulfide, gold sulfide or nickel sulfide, equal results were obtained.

EXAMPLE 14

Color photographic papers were produced in the same manner as in Example 13, except for adding a colloid of metallic palladium, metallic gold, metallic platinum, palladium sulfide, gold sulfide, nickel sulfide or silver sulfide to the 1st layer instead of the 2nd layer. Each of the samples was subjected to Processing a as described in Example 12, and the cyan image density was determined. The results obtained were equal to those of Example 12.

EXAMPLE 15

The same procedure of Example 14 was repeated, except for adding the colloidal metal used in Example 3 to 3rd layer in place of the 1st layer. The results obtained were equal to those of Example 14.

As described above, a direct positive having a high maximum density as well as very excellent graininess can be obtained without increasing the minimum density by using a internal latent image type direct positive light-sensitive material according to the present invention which has not been previously fogged.

The high maximum image density and excellent graininess can be achieved even when the light-sensitive material is processed with a highly stable developing solution having a low pH value.

While the invention has been described in detail and with reference to specific embodiments thereof, it will be apparent to one skilled in the art that various changes and modifications can be made therein without departing from the spirit and scope thereof.

What is claimed is:

1. A direct positive photographic material comprising a support having provided thereon one or more hydrophillic colloid containing layers, wherein at least oen of said hydrophillic colloid containing layers is an internal latent image type silver halide emulsion which has not been previously fogged and at least one of said emulsion layer or other hydrophillic colloid containing layer contains a colloidal metal selected from the group consisting of mercury, iron, lead, zinc, nickel, cadmium, tin, chromium, copper, cobalt, gold, platinum and palladium or a colloidal water-insoluble metallic sulfide, selenide or telluride selected from the group consising of sulfides, selenides, or tellurides of mercury, iron, lead, zinc, nickel, cadmium, tin, chromium, copper, cobalt, gold, platinum, palladium, alluminum, silver, antimony, bismuth, cerium or magnesium.

2. A direct positive photographic material as claimed in claim 1, wherein the colloidal metal is selected from the group consisting of nickel, iron, cobalt, copper, palladium, gold and platninum and the metal for the water-insoluble metallic sulfide, selenide or telluride is selected from the group consising of nickel, iron, cobalt, copper, palladium, gold, platinum.

3. A direct positive photograohic material as claimed in claim 1, wherein the colloidal metal is incorporated into at least one hydrophilic colloid containing layer other than one of said internal latent image type silver halide emulsion containing layers.

4. A direct positive photographic material as claimed in claim 3, wherein the colloid metal is incorporated into layer adjacent to one of said internal latent image type silver halide emulsion layers.

5. A direct positive photographic material as claimed in claim 3, wherein the amount of the colloidal metal is from $10^{-10}$ to $10^{-4}$ mol per m$^2$.

* * * * *